US012778284B2

(12) United States Patent
Wu

(10) Patent No.: US 12,778,284 B2
(45) Date of Patent: Nov. 3, 2026

(54) ROD FIXING STRUCTURE

(71) Applicant: Boyi Wu, Fujian (CN)

(72) Inventor: Boyi Wu, Fujian (CN)

( * ) Notice: Subject to any disclaimer, the term of this patent is extended or adjusted under 35 U.S.C. 154(b) by 0 days.

(21) Appl. No.: 19/575,840

(22) Filed: Mar. 23, 2026

(65) Prior Publication Data

US 2026/0224027 A1 Aug. 6, 2026

Related U.S. Application Data

(63) Continuation-in-part of application No. PCT/CN2025/072998, filed on Jan. 17, 2025.

(30) Foreign Application Priority Data

Feb. 27, 2024 (CN) ..... 202420362779.0
Apr. 9, 2024 (CN) ..... 202420715565.7
Jul. 3, 2024 (CN) ..... 202421559789.X

(51) Int. Cl.
*A47B 57/54* (2006.01)
*A47B 57/44* (2006.01)
*A47B 57/50* (2006.01)

(52) U.S. Cl.
CPC ..... *A47B 57/545* (2013.01); *A47B 57/44* (2013.01); *A47B 57/50* (2013.01)

(58) Field of Classification Search
CPC ..... A47B 57/545; A47B 57/44; A47B 57/50
USPC ..... 108/147.11, 147.12, 147.13, 147.14
See application file for complete search history.

(56) References Cited

U.S. PATENT DOCUMENTS 3,983,823 A * 10/1976 McDonnell ..... A47F 5/10 108/147.11
4,811,670 A * 3/1989 Kolvites ..... A47B 57/265 211/187
5,409,122 A * 4/1995 Lazarus ..... A47B 47/028 403/312
6,017,009 A * 1/2000 Swartz ..... A47B 57/10 248/245
6,044,988 A * 4/2000 Yang ..... A47B 57/265 211/187
6,079,575 A * 6/2000 Wang ..... A47B 57/265 211/187
6,253,687 B1 * 7/2001 McAllister ..... A47B 57/545 108/107

(Continued)

FOREIGN PATENT DOCUMENTS

CN 1603639 A 4/2005
CN 201767392 U 3/2011

(Continued)

*Primary Examiner* — Jose V Chen
(74) *Attorney, Agent, or Firm* — Birchwood IP

(57) ABSTRACT

A rod fixing structure, including connecting sleeve, wherein the connecting sleeve has a sleeve hole with two ends in communication with each other, the sleeve hole being a tapered hole with a narrow upper part and a wide lower part; at least two connecting wings are provided on an outer wall of the connecting sleeve, spaced apart from each other on an outer circumference of the connecting sleeve; and the connecting sleeve is configured to be sleeve a vertically-arranged supporting rod, and each connecting wing is configured to be fixed to a horizontally-arranged horizontal support rod. The connecting sleeve is an independent structure and can be detachably connected to the support rod.

15 Claims, 16 Drawing Sheets

(56) References Cited

U.S. PATENT DOCUMENTS 6,253,933 B1 * 7/2001 Yang ..... A47B 57/545
211/187
6,302,284 B1 * 10/2001 Zonshin ..... A47B 47/0083
108/147.11
6,364,139 B1 * 4/2002 Chen ..... A47B 57/265
248/245
6,550,730 B1 * 4/2003 Hong ..... F16B 7/048
211/187
6,659,410 B1 * 12/2003 Lu ..... A47B 13/021
248/188
6,726,040 B1 * 4/2004 Chen ..... A47F 5/13
211/187
7,478,971 B2 * 1/2009 Li ..... A47B 57/562
403/398
7,992,730 B2 * 8/2011 Huang ..... A47B 57/265
211/187
8,333,160 B2 * 12/2012 Lin ..... B25H 3/02
108/25
9,167,915 B1 * 10/2015 Lau ..... A47B 57/545
9,301,610 B1 * 4/2016 Berry ..... F16B 12/02
10,058,174 B1 * 8/2018 Tang ..... A47B 57/545
10,806,257 B1 * 10/2020 Liu ..... A47B 47/024
11,627,802 B1 * 4/2023 Liu ..... A47B 57/40
211/187
2003/0131767 A1 * 7/2003 Chen ..... A47B 57/265
108/147.13
2017/0086579 A1 * 3/2017 Kam ..... A47B 57/44
2019/0290000 A1 * 9/2019 Davis ..... A47F 5/13
2019/0343277 A1 * 11/2019 Sabounjian ..... A47B 47/0083
2024/0008641 A1 * 1/2024 Briosi ..... A47B 57/402
2024/0251943 A1 * 8/2024 Reppert ..... A47B 57/583

FOREIGN PATENT DOCUMENTS

CN 221723175 U 9/2024
CN 221903031 U 10/2024

* cited by examiner

ROD FIXING STRUCTURE

TECHNICAL FIELD

The present invention relates to the technical field of hardware connectors, and in particular to a rod fixing structure.

BACKGROUND OF THE INVENTION

Shelving racks, commonly used for storing items, are widely applied for goods storage in for example supermarkets, warehouses, and express delivery points. Common shelving racks include steel wire mesh shelves, angle steel racks, and the like. For example, a storage device disclosed in CN2263478Y comprises a plurality of support rods and a plurality of horizontal racks, wherein the horizontal racks and the support rods are typically connected using connectors. In this patent, trumpet-shaped sleeves are integrally fixed on each horizontal rack, and each trumpet-shaped sleeve cooperates with a sleeving element to achieve an adjustable connection with the support rod. However, because the trumpet-shaped sleeves are integrally located on each horizontal rack, positions of the support rods relative to one another must be precisely located during assembly of the storage device; otherwise the trumpet-shaped sleeves cannot be smoothly sleeved onto the corresponding support rods. This makes assembly and disassembly of the storage device relatively difficult.

BRIEF SUMMARY OF THE INVENTION

An object of the present invention is to provide a rod fixing structure that has the advantages of convenient assembly and disassembly.

To attain the above object, the present invention provides the following technical solutions:

A rod fixing structure, comprising a connecting sleeve; the connecting sleeve has a sleeve hole penetrating through two ends of the connecting sleeve, and the sleeve hole is a tapered hole that has an upper portion narrower than a lower portion thereof; an outer wall of the connecting sleeve is provided with at least two connecting wings; said at least two connecting wings are located around a central axis of the sleeve hole and spaced apart from each other, and said at least two connecting wings are fixed around an outer circumference of the connecting sleeve and project radially from the outer circumference of the connecting sleeve; the connecting sleeve is configured to sleeve a support rod which is vertically arranged, and each of said at least two connecting wings is configured to be locked or buckled to a horizontal rod which is horizontally arranged.

A horizontal cross-section of the sleeve hole is circular, elliptical, triangular or rectangular; the outer wall of the connecting sleeve is tapered to define a shape of a cylinder, a conical frustum, or a prismatic frustum.

Each of said at least two connecting wings is welded and fixed to the outer wall of the connecting sleeve.

Said at least two connecting wings are vertically arranged on the outer wall of the connecting sleeve; inner side edges of said at least two connecting wings are connected to locking portions that abut against the outer wall of the connecting sleeve, and the locking portions are locked and fixed to the outer wall of the connecting sleeve.

Also comprising connecting screws; each of the locking portions is provided with at least two connecting holes vertically spaced apart from each other; portions of the outer wall of the connecting sleeve corresponding to the locking portions 21 are each provided with at least two locking holes corresponding to said at least two connecting holes, and internal threads are provided in each of said at least two locking holes; an exact quantity of the connecting screws corresponds to an exact quantity of said at least two connecting holes; the connecting screws pass through said at least two connecting holes and are locked into said at least two locking holes respectively, thereby locking and fixing said at least two connecting wings to the connecting sleeve.

Each of said at least two connecting wings comprises a first side plate and a second side plate that are spaced apart from and parallel to each other; a respective one of the locking portions is connected to inner side edges of the first side plate and the second side plate of each of said at least two connecting wings; the first side plate and the second side plate are each provided with at least one quick-connect hole or at least one quick-connect fastener; a reinforcing plate is connected to outer side edges of the first side plate and the second side plate of each of the locking portions; the reinforcing plate is provided with at least two alignment holes corresponding to said at least two connecting holes; the connecting screws pass through said at least two alignment holes and are then locked and fixed with said at least two connecting holes and said at least two locking holes.

Said at least two connecting wings comprise two to four connecting wings spaced apart from one another equivalently by 90-degree around the outer wall of the connecting sleeve.

The connecting sleeve is an assembled structure; the connecting sleeve is divided longitudinally along a diameter thereof into a first arc piece and a second arc piece that are detachably connected; the sleeve hole is defined between the first arc piece and the second arc piece connected to each other.

Each of two side end surfaces of each of the first arc piece and the second arc piece is provided with at least one connecting locking hole penetrating an end face of a respective side end surface and an outer arc surface of a respective one of the first arc piece and the second arc piece, such that there are at least two connecting locking holes on the first arc piece and at least two connecting locking holes on the second arc piece; when the first arc piece and the second arc piece are connected, said at least two connecting locking holes of the first arc piece align with said at least two connecting locking holes of the second arc piece respectively; a locking screw is detachably threaded through each pair of aligned connecting locking holes.

One of two side end surfaces of each of the first arc piece and the second arc piece is provided with at least one locking block that protrudes along a circumferential direction of the connecting sleeve, and another one of two side end surfaces of each of the first arc piece and the second arc piece is recessed along the circumferential direction of the connecting sleeve to form at least one locking groove; each of upper and/or lower end surfaces of each of the first arc piece and the second arc piece is provided with a locking through hole that corresponds and axially communicate with said at least one locking groove thereon; when the first arc piece and the second arc piece are connected, said at least one locking block of the first arc piece is embedded into said at least one locking groove of the second arc piece 14, and said at least one locking block of the second arc piece is correspondingly embedded into said at least one locking groove of the first arc piece; each locking block on the first arc piece and the second arc piece is provided with a locking bottom hole corresponding to a respective locking through hole; a locking screw is detachably locked into each pair of corresponding locking bottom hole and locking through hole.

When the first arc piece and the second arc piece is connected to form the connecting sleeve, each of two end surfaces of the connecting sleeve formed by the first arc piece and the second arc piece is locked with two half-ring locking pieces respectively, such that there are two half-ring locking pieces on an upper end surface of the connecting sleeve, and two half-ring locking pieces on a lower end surface of the connecting sleeve; each half-ring locking piece has two locking piece connecting portions distributed along a circumferential direction of the connecting sleeve, and the two locking piece connecting portions span on a respective one of the upper end surface and the lower end surface of the connecting sleeve at least across a point of connection between the first arc piece and the second arc piece so as to lock the first arc piece and the second arc piece; each locking piece connecting portion is provided with at least one locking piece through hole; an upper end surface of the first arc piece and an upper end surface of the second arc piece are each provided with at least two arc piece locking holes corresponding to at least two locking piece through holes from two locking piece connecting portions of the two half-ring locking pieces on the upper end surface of the connecting sleeve respectively; similarly, a lower end surface of the first arc piece and a lower end surface of the second arc piece are each provided with at least two arc piece locking holes corresponding to at least two locking piece through holes from two locking piece connecting portions of the two half-ring locking pieces on the lower end surface of the connecting sleeve respectively; fasteners are provided to pass through all locking piece through holes respectively and then lock into corresponding arc piece locking holes respectively, so that all half-ring locking pieces are locked and fixed to the first arc piece and the second arc piece.

Also comprising a sleeve assembly; an outer circumferential wall of the support rod is provided with a plurality of annular clamping grooves; the sleeve assembly comprises two half sleeve bodies that are removably snap-fitted to each other; an inner wall of the sleeve assembly removably abuts the outer circumferential wall of the support rod, and the inner wall of the sleeve assembly protrudes with annular ribs that are capable of being fitted in any one of the plurality of annular clamping grooves; an outer wall of the sleeve assembly is a tapered wall corresponding to the sleeve hole.

Also comprising at least one fastener for each of said at least two connecting wings; each of said at least two connecting wings is provided with at least one connecting through hole; at least one of two ends of the horizontal rod is provided with at least one connecting perforation corresponding to said at least one connecting through hole of a corresponding connecting wing; an exact quantity of said at least one fastener for each of said at least two connecting wings corresponds to an exact quantity of said at least one connecting through hole, and said at least one fastener sequentially passes through said at least one connecting through hole and said at least one connecting perforation to lock and fix the horizontal rod and the corresponding connecting wing. Each of said at least one fastener may be a set of nut and bolt.

The horizontal rod is a square hollow horizontal rod; two opposite sides of each of the two ends of the horizontal rod 6 are pressed against each other to form a closed end having a shape of hollow letter U; each closed end of the horizontal rod is provided with said at least one connecting perforation corresponding to said at least one connecting through hole of the corresponding connecting wing.

When the corresponding connecting wing is locked and fixed to the horizontal rod, the corresponding connecting wing is connected to a respective closed end of the horizontal rod and abuts against an inner bottom wall of the shape of hollow letter U of the respective closed end.

Upper and lower edges of each of said at least two connecting wings are provided with two flanges, so that one surface of each of said at least two connecting wings forms a C-shaped opening; when each of said at least two connecting wings is locked and fixed to the horizontal rod, the C-shaped opening faces towards the shape of hollow letter U of a respective closed end of the horizontal rod, with the two flanges extending into the shape of hollow letter U, and outer side walls of the two flanges elastically abut two side walls of the shape of hollow letter U of the respective closed end; said at least one fastener sequentially passes through said at least one connecting through hole of the corresponding connecting wing and said at least one connecting perforation of the respective closed end, so that the corresponding connecting wing and the respective closed end of the horizontal rod are fitted and connected.

Each of said at least two connecting wings is provided with at least one quick-connect hole or at least one quick-connect fastener; each of two ends of the horizontal rod is provided with at least one quick-connect fastener or at least one quick-connect hole corresponding respectively to said at least one quick-connect hole 31 or said at least one quick-connect fastener of a corresponding connecting wing.

Each quick-connect hole is a gourd-shaped hole, a teardrop-shaped hole, a vertically elongated rectangular hole, or a horizontally elongated rectangular hole; each quick-connect fastener is a bolt-shaped protruding structure, a right-angled protrusion, or a protruded tapered elastic insertion plate.

The support rod is a bed leg rod, and the horizontal rod is a cross beam rod; an upper portion of the bed leg rod is sleeved by the connecting sleeve; a sleeve assembly is provided between the connecting sleeve and the bed leg rod; an outer wall of the upper portion of the bed leg rod is provided with an annular clamping groove; the sleeve assembly comprises two half sleeve bodies that are removably snap-fitted to each other; an inner wall of the sleeve assembly removably abuts an outer circumferential wall of the bed leg rod, and the inner wall of the sleeve assembly protrudes with annular ribs that are capable of being fitted in the annular clamping groove; an outer wall of the sleeve assembly is a tapered wall corresponding to the sleeve hole; the connecting sleeve sleeves the sleeve assembly.

Each of said at least two connecting wings comprises a fixing piece and a connecting piece that are parallel and spaced apart from each other; an inner end of the fixing piece is connected to the outer wall of the connecting sleeve disposed at the upper portion of the bed leg rod; an outer end of the fixing piece and an outer end of the connecting piece are integrally connected through an arc-shaped connecting section; the connecting piece is provided with said at least one quick-connect hole.

According to the technical solutions provided by the present invention, the connecting sleeve is an independent structure that can be detachably connected to a support rod. Since the connecting sleeve is provided with at least two connecting wings, each of said at least two connecting wings and a corresponding horizontal rod can be locked or buckled. Thus, the vertically arranged support rod can be conveniently connected to the horizontally arranged horizontal rod through the connecting sleeve. Accordingly, there can be four support rods, and the connecting sleeve sleeving each of the four support rods has two connecting wings; one horizontal rod can be conveniently installed between every two adjacent support rods. Two ends of each horizontal rod are connected to two connecting wings respectively of two connecting sleeves sleeving two adjacent support rods of the four support rods, thereby forming the frame structure. The frame structure can be further embodied as a shelving rack or even a bed frame. Compared with existing prior art storage rack, the present invention provides a structure easier to assemble and disassemble, and the overall structure of the product according to the present invention is more stable and reliable.

DETAILED DESCRIPTION OF THE INVENTION

Figure 1:
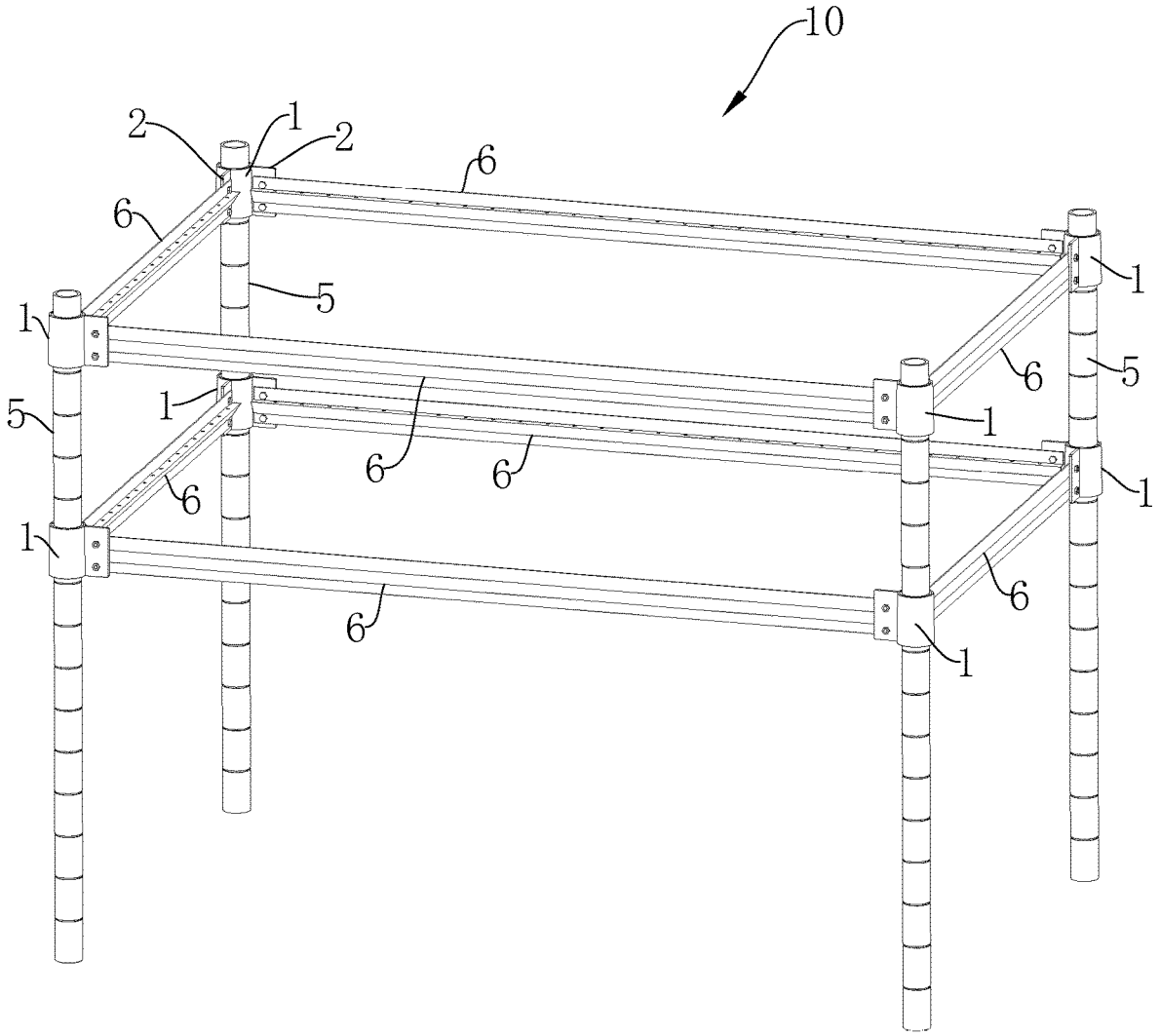
FIG. 1 is a perspective view showing Embodiment 1 of the present invention applied to a frame structure.

To make the objectives, technical solutions, and advantages of the embodiments of the present invention clearer, the technical solutions in the embodiments of the present invention will be clearly and thoroughly described below with reference to the accompanying drawings in the embodiments of the present invention. Obviously, the described embodiments are some but not all embodiments of the present invention. Components of the embodiments of the present invention generally described and illustrated in the drawings herein may be arranged and designed in various different configurations.

Embodiment 1

Figure 2:
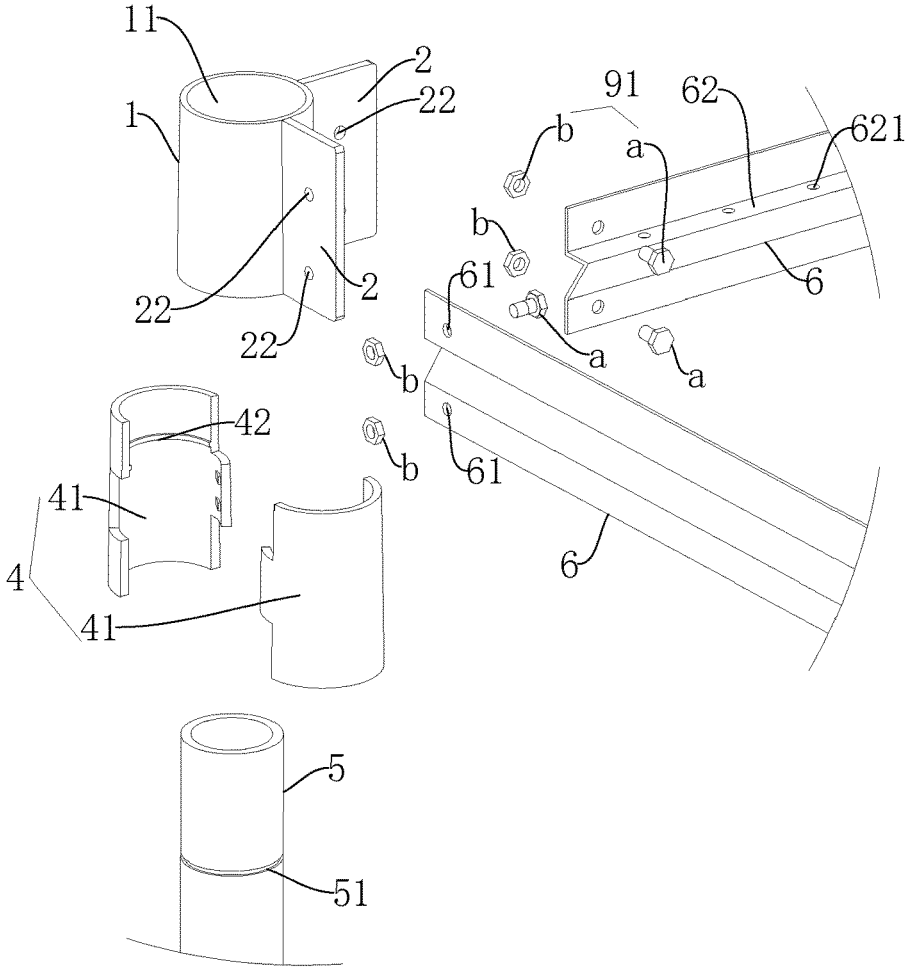
FIG. 2 is a partial structural schematic view of Embodiment 1 of the present invention.
Figure 3:
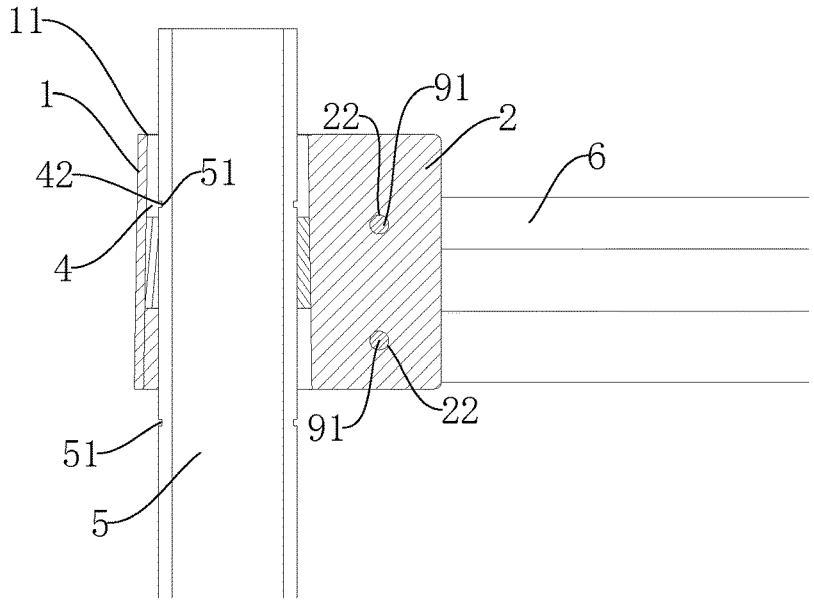
FIG. 3 is a cross-sectional view of the frame structure of Embodiment 1 of the present invention.

As shown in FIGS. 1 to 3, a rod fixing structure of the present invention is illustrated and applied to a frame structure 10.

The rod fixing structure comprises a connecting sleeve 1. The connecting sleeve 1 has a sleeve hole 11 penetrating through two ends of the connecting sleeve 1, and the sleeve hole 11 is a tapered hole that has an upper portion narrower than a lower portion thereof. An outer wall of the connecting sleeve 1 is provided with at least two connecting wings 2. Said at least two connecting wings 2 are located around a central axis of the sleeve hole 11 and spaced apart from each other, and said at least two connecting wings are fixed around an outer circumference of the connecting sleeve 1 and project radially from the outer circumference of the connecting sleeve 1. Each of said at least two connecting wings 2 is provided with at least one connecting through hole 22. The connecting sleeve 1 is configured to sleeve a vertically arranged support rod 5, and each of said at least two connecting wings 2 is configured to be locked and fixed to a horizontally arranged horizontal rod 6.

Accordingly, the connecting sleeve 1 is an independent structure that can be detachably connected to a support rod 5. Since the connecting sleeve 1 is provided with at least two connecting wings 2 and each of said at least two connecting wings 2 is provided with at least one connecting through hole 22, each of said at least two connecting wings 2 and the corresponding horizontal rod 6 can be locked and fixed by at least one fastener 91 each being such as a screw or a set of bolt a and nut b. Thus, the vertically arranged support rod 5 can be conveniently connected to the horizontally arranged horizontal rod 6 through the connecting sleeve 1.

Accordingly, in an exemplary frame structure 10, there can be four support rods 5, and the connecting sleeve 1 sleeving each of the four support rods 5 has two connecting wings 2; one horizontal rod 6 can be conveniently installed between every two adjacent support rods 5. Two ends of each horizontal rod 6 are connected to two connecting wings 2 respectively of two connecting sleeves 1 sleeving two adjacent support rods 5 of the four support rods 5, thereby forming the frame structure 10.

Figure 4:
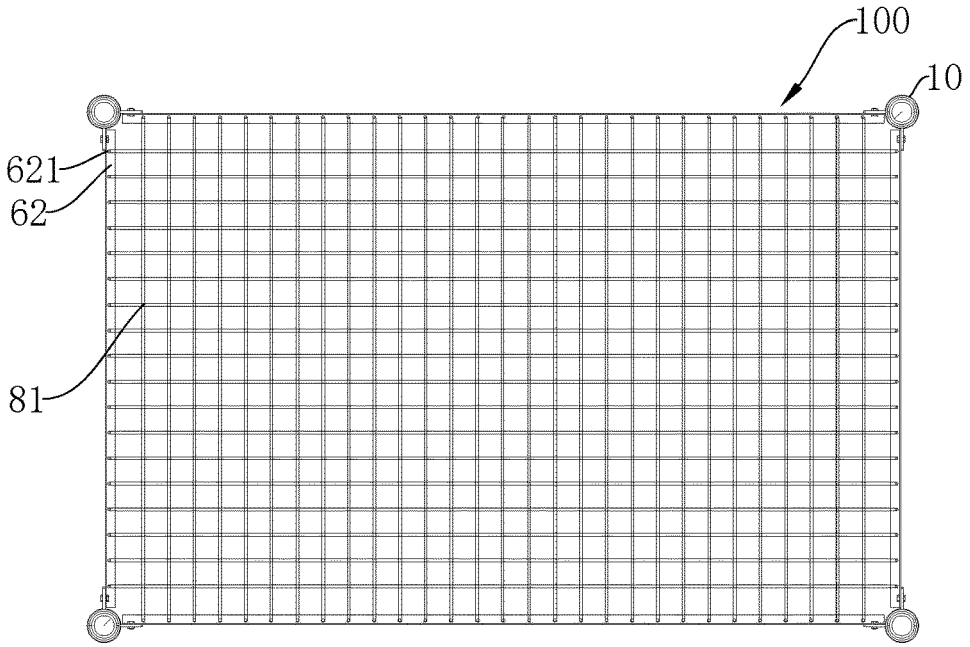
FIG. 4 is a first schematic view of the shelving rack of Embodiment 1 of the present invention.
Figure 5:
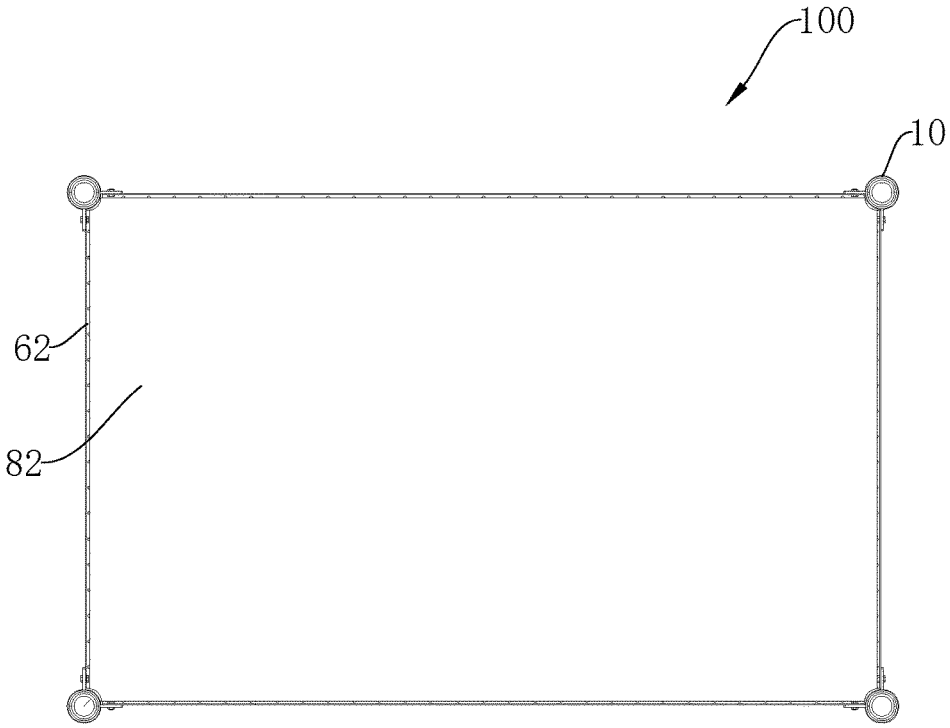
FIG. 5 is a second schematic view of the shelving rack of Embodiment 1 of the present invention.

Referring further to FIGS. 2, 4 and 5, a middle portion of the horizontal rod 6 has a protrusion having a cross-section in a shape of numeral "7", thereby forming a platform 62 on the horizontal rod 6. Thus, by supporting a meshed board 81 (as shown in FIG. 4) or a partition board 82 (as shown in FIG. 5) on platforms 62 of all horizontal rods 6, the frame structure 10 is further modified as a shelving rack 100. In the present embodiment, the platform 62 of each horizontal rod 6 may further be provided with positioning holes 621 to facilitate placement of the meshed board 81; alternatively, bed slats (not shown) and/or a bed board (not shown) may be placed on the platforms 62 of all or some of the horizontal rods 6, so that the frame structure 10 can function as a bed frame structure. Further, said at least one fastener 91 locks and fixes each connecting wing 2 and a corresponding horizontal rod 6, so that an overall structure of the shelving rack or bed frame structure is more stable and reliable.

As shown in FIGS. 2 and 3, the rod fixing structure further comprises a sleeve assembly 4.

An outer circumferential wall of the support rod 5 is provided with a plurality of annular clamping grooves 51. Thus, when the frame structure 10 is modified as a shelving rack 100, a plurality of connecting sleeves 1 can be provided on each support rod 5, and connecting sleeves 1 of a same height on all support rods 5 can constitute a layer of storage area when being cooperatively provided with horizontal rods 6 each being connected to every two adjacent connecting sleeves 1 of the same height and the meshed board 81 placed on the horizontal rods 6.

Moreover, the tapered sleeve hole 11 of the connecting sleeve 1 also facilitates quick adjustment of a vertical spacing between two meshed boards 81 of the shelving rack 100, and such technical effects and the specific ways to attain such technical effects are well known in the prior art.

The sleeve assembly 4 comprises two half sleeve bodies 41 that are removably snap-fitted to each other. An inner wall of the sleeve assembly 4 removably abuts the outer circumferential wall of the support rod 5, and the inner wall of the sleeve assembly 4 protrudes with annular ribs 42 that are capable to be fitted in any one of the plurality of annular clamping grooves 51. An outer wall of the sleeve assembly 4 is a tapered wall corresponding to the sleeve hole 11.

Each of the two ends of each horizontal rod 6 is provided with at least one connecting perforation 61 corresponding to said at least one connecting through hole 22 of a corresponding connecting wing 2. An exact quantity of said at least one fastener 91 corresponds to an exact quantity of said at least one connecting through hole 22, and said at least one fastener 91 sequentially passes through said at least one connecting through hole 22 and at least one connecting perforation 61 to lock and fix the horizontal rod 6 and the corresponding connecting wing 2.

In the present embodiment, each connecting wing 2 is provided with two vertically arranged connecting through holes 22, and each of the two ends of each horizontal rod 6 is also provided with two vertically distributed connecting perforations 61. In the present embodiment, each of said at least one fastener 91 is a set of bolt a and nut b. After the bolt a passes through a corresponding connecting through hole 22 and a corresponding connecting perforation 61, the nut b is tightened to achieve detachable locking and fixation of the horizontal rod 6 to the corresponding connecting wing 2.

In the present embodiment, a horizontal cross-section of the sleeve hole 11 is circular. Since the sleeve hole 11 is a tapered hole, the outer wall of the connecting sleeve 1 may also be correspondingly tapered to define a shape of a conical frustum. Of course, the horizontal cross-section of the sleeve hole 11 may also be elliptical, triangular or rectangular, as long as the sleeve hole 11 is tapered to achieve an effect of tightly embracing the sleeve assembly 4. The outer wall of the connecting sleeve 1 is independent from a shape of the sleeve hole 11, i.e., the connecting sleeve 1 may be cylindrical, a conical frustum, or a prismatic frustum etc. In other words, a horizontal cross-section of the sleeve hole 11 and a shape of the connecting sleeve 1 may be independent of each other.

In the present embodiment, each of said at least two connecting wings 2 is welded and fixed to the outer wall of the connecting sleeve 1.

Embodiment 2

Figure 6:
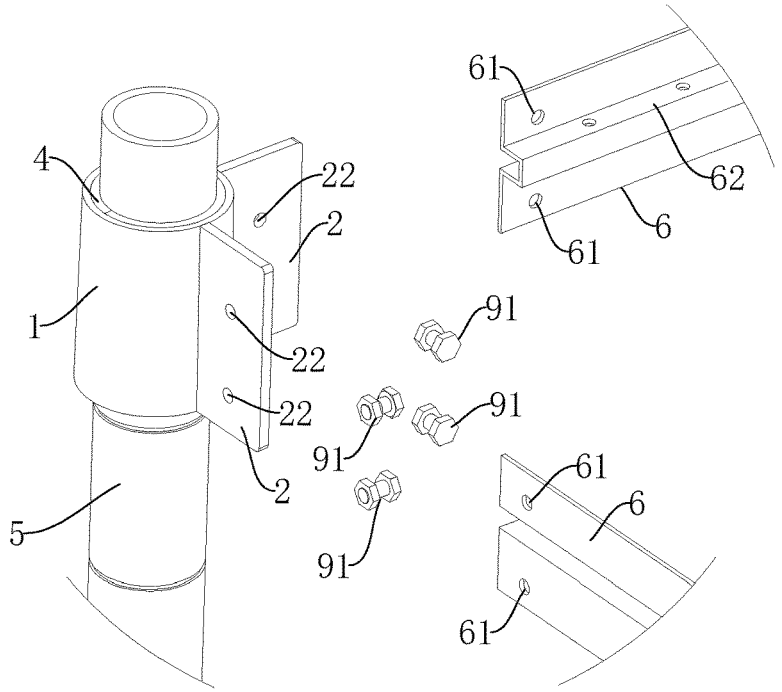
FIG. 6 is a partial structural schematic view of Embodiment 2 of the present invention.

As shown in FIG. 6, a structure of the present embodiment is similar to that of embodiment 1, with a main difference in that the horizontal rod 6 of the present embodiment has a protrusion having a cross-section in a U-shape; likewise, the present embodiment has the platform 62 formed on the protrusion.

Embodiment 3

Figure 7:
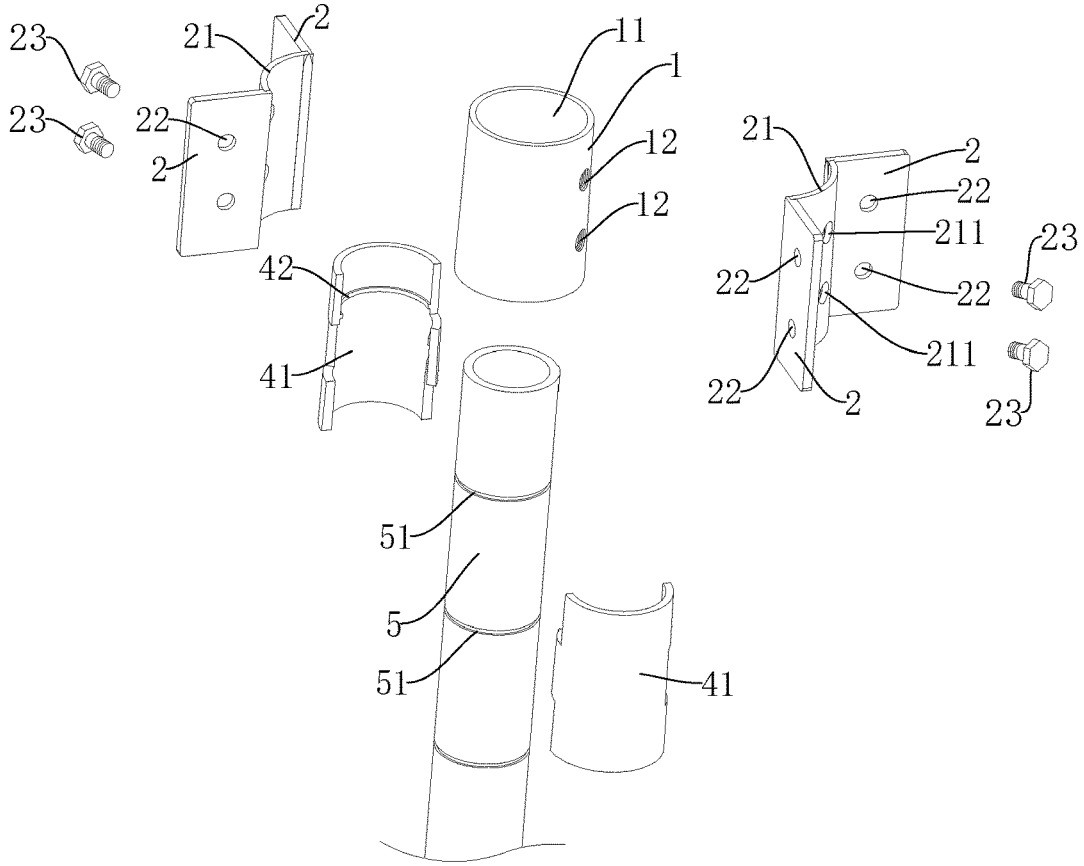
FIG. 7 is a partial structural schematic view of Embodiment 3 of the present invention.

As shown in FIG. 7, a structure of the present embodiment is similar to that of embodiment 1, with a main difference in that said at least two connecting wings 2 of the present embodiment are detachably fixed to the outer wall of the connecting sleeve 1 via connecting screws 23.

Specifically, said at least two connecting wings 2 of the present embodiment comprises four connecting wings 2, and the four connecting wings 2 are vertically arranged on the outer wall of the connecting sleeve 1. Inner side edges of the four connecting wings 2 are connected to locking portions 21 that abut against the outer wall of the connecting sleeve 1, and the locking portions 21 are locked and fixed to the outer wall of the connecting sleeve 1. In the present embodiment, there are two locking portions 21 each being connected with two of the four connecting wings 2, specifically, two side edges of each of the two locking portions 21 are connected to said two of the four connecting wings 2 respectively.

Each of the two locking portions 21 is provided with at least two connecting holes 211 vertically spaced apart from each other. The outer wall of the connecting sleeve 1 corresponding to each of the two locking portions 21 is provided with at least two locking holes 12 corresponding to said at least two connecting holes 211, and internal threads are provided in each of said at least two locking holes 12.

An exact quantity of the connecting screws 23 corresponds to an exact quantity of said at least two connecting holes 211. The connecting screws 23 pass through said at least two connecting holes 211 and are locked into said at least two locking holes 12 respectively, thereby locking and fixing the four connecting wings 2 to the connecting sleeve 1.

In the present embodiment, there are four connecting wings 2 spaced apart from one another equivalently by 90-degree around the outer wall of the connecting sleeve 1. This allows the support rod 5 to have four connecting wings 2 in four directions respectively. Thus, the connecting sleeve 1 and the sleeved support rod 5 can serve as a central support structure for four shelving racks built around the connecting sleeve 1 and the sleeved support rod 5. While saving support rods 5 and connecting sleeves 1, the four shelving racks are connected integrally into one body by the rod connecting structure according to the present embodiment to improve stability performance of the shelving racks and realizing extension of the shelving racks.

Embodiment 4

Figure 8:
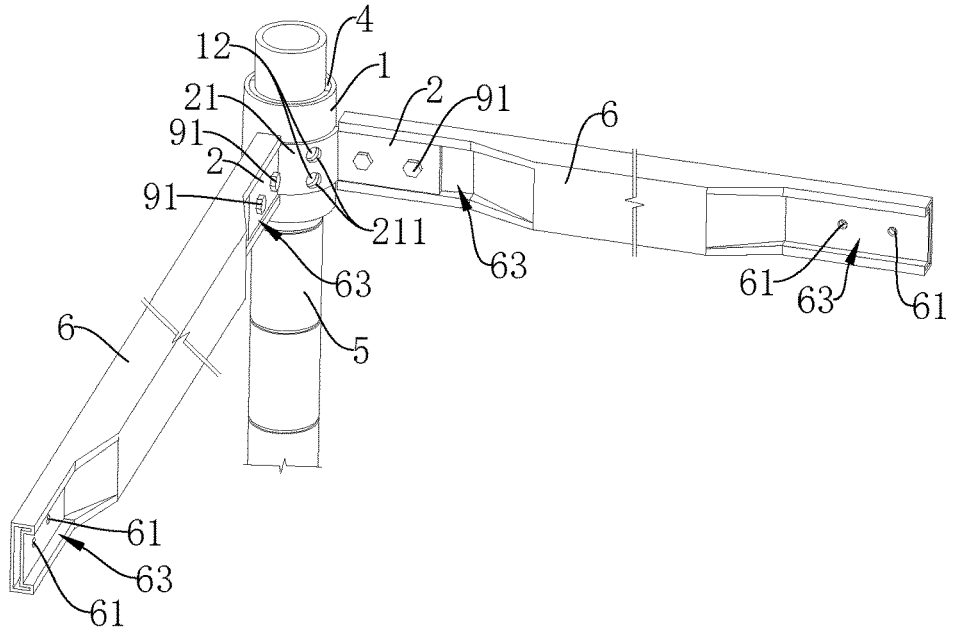
FIG. 8 is a perspective view of the partial structure of Embodiment 4 of the present invention.
Figure 9:
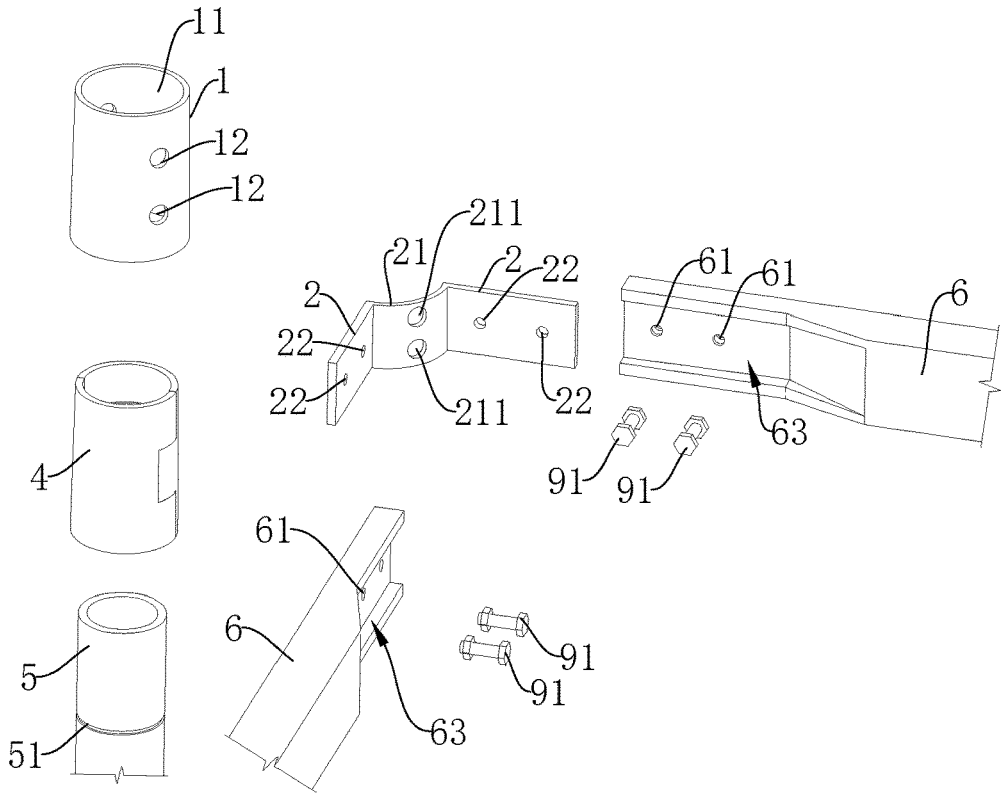
FIG. 9 is an exploded view of the partial structure of Embodiment 4 of the present invention.

As shown in FIGS. 8 and 9, a structure of the present embodiment is similar to embodiment 3, with a main difference in that the horizontal rod 6 of the present embodiment is a square hollow horizontal rod so as to have stronger supporting force and structural strength.

Furthermore, two opposite sides of each of two ends of the horizontal rod 6 are pressed against each other to form a closed end 63 having a shape of hollow letter U. Each closed end 63 of the horizontal rod 6 is provided with at least one connecting perforation 61 corresponding to said at least one connecting through hole 22.

Thus, when a corresponding connecting wing 2 is locked and fixed to the horizontal rod 6, the corresponding connecting wing 2 is connected to a respective closed end 63 of the horizontal rod 6 and abuts against an inner bottom wall of the shape of hollow letter U of the respective closed end.

In the present embodiment, each connecting wing 2 is provided with two connecting through holes 22 horizontally spaced apart from each other, and two corresponding connecting perforations 61 also horizontally spaced apart from each other are provided on each closed end 63. By connecting the connecting wing 2 with the inner bottom wall of the shape of hollow letter U of the respective closed end 63, a tighter connection between the connecting wing 2 and the horizontal rod 6 is achieved while maintaining a sightly appearance.

Embodiment 5

Figure 10:
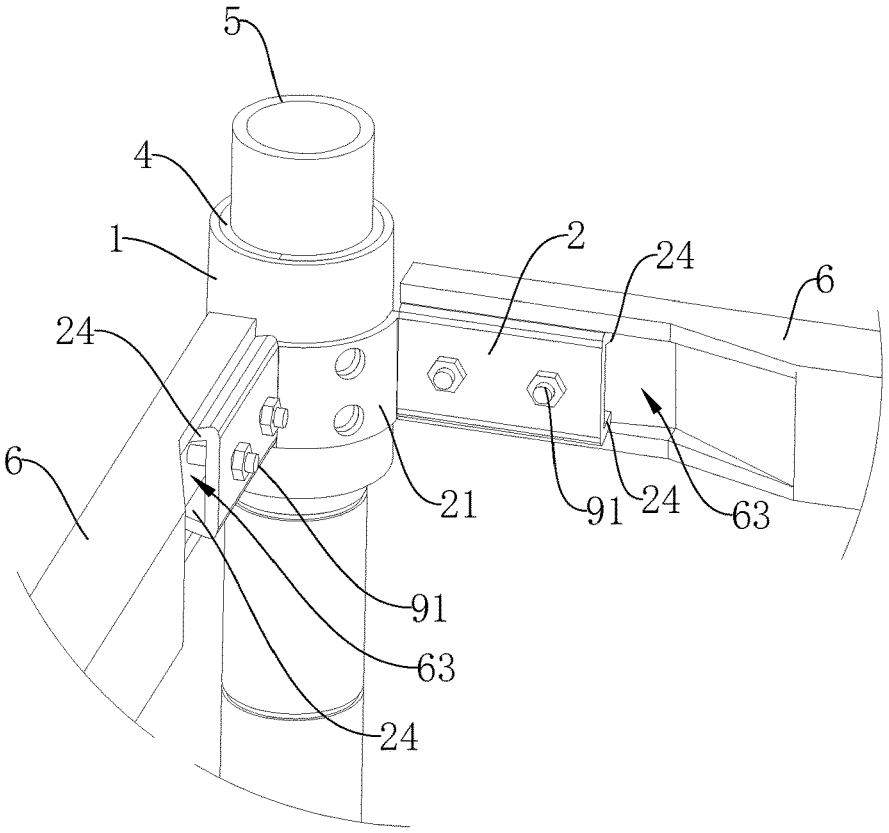
FIG. 10 is a perspective view of the partial structure of Embodiment 5 of the present invention.
Figure 11:
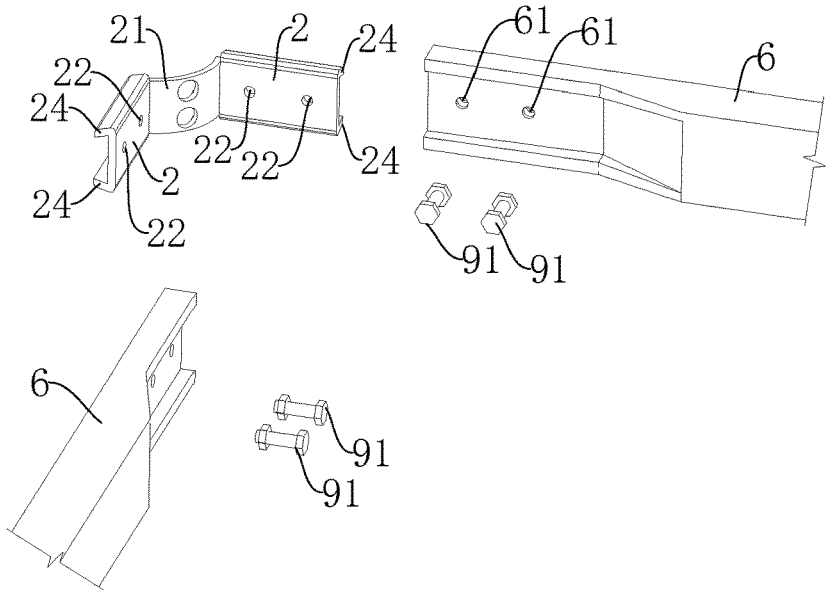
FIG. 11 is an exploded view of the partial structure of Embodiment 5 of the present invention.

As shown in FIGS. 10 and 11, a structure of the present embodiment is substantially the same as a structure of the embodiment 4, with a main difference in that the horizontal rod 6 of the present embodiment is a square hollow horizontal rod so as to have stronger supporting force and structural strength.

Furthermore, two opposite sides of each of two ends of the horizontal rod 6 are pressed against each other to form a closed end 63 having a shape of a hollow letter U. Each closed end 63 of the horizontal rod 6 is provided with at least one connecting perforation 61 corresponding to said at least one connecting through hole 22.

Upper and lower edges of each of said at least two connecting wings 2 are provided with two flanges 24, so that one surface of each of said at least two connecting wings 2 forms a C-shaped opening. When each of said at least two connecting wings 2 is locked and fixed to a corresponding horizontal rod 6, the C-shaped opening faces towards the shape of hollow letter U of a respective closed end 63 of the corresponding horizontal rod 6, with the two flanges 24 extending into the shape of hollow letter U, and outer side walls of the two flanges 24 elastically abut two side walls of the shape of hollow letter U of the respective closed end 63. Said at least one fastener 91 sequentially pass through said at least one connecting through hole 22 and said at least one connecting perforation 61, so that each of said at least two connecting wings 2 and the closed end 63 of the corresponding horizontal rod 6 are tightly fitted and connected.

Moreover, when each of said at least one fastener 91 is a set of bolt a and nut b, a tight fit between each of said at least two connecting wings 2 and the corresponding horizontal rod 6 can also provide a reaction force to the bolt a and the nut b, preventing the nut b and the bolt a from loosening and separating from each other, thereby improving the connection stability of the connecting wing 2 and the horizontal rod 6.

Embodiment 6

Figure 12:
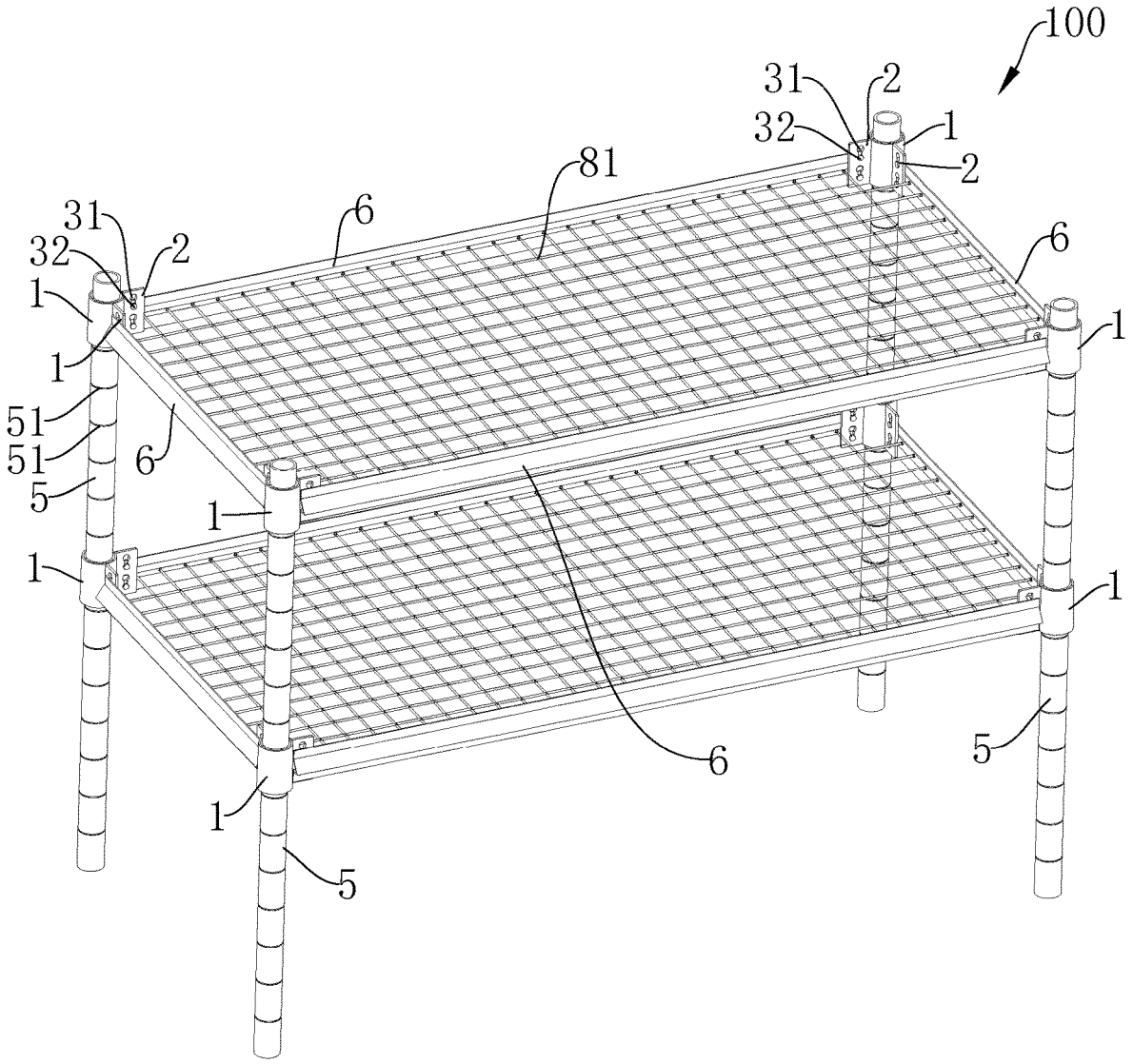
FIG. 12 is a perspective view showing Embodiment 6 of the present invention applied to a shelving rack.
Figure 13:
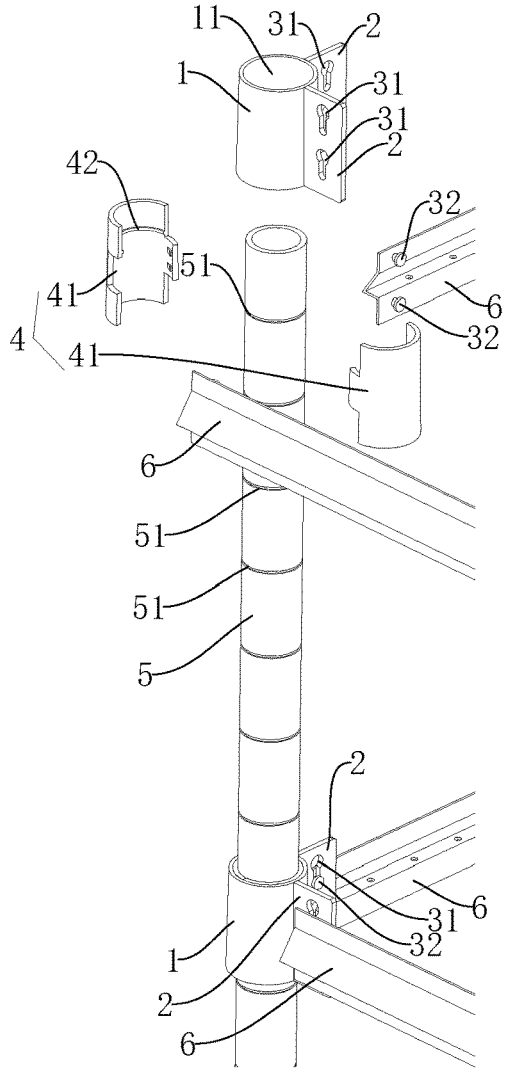
FIG. 13 is an exploded view of the partial structure of Embodiment 6 of the present invention.
Figure 14:
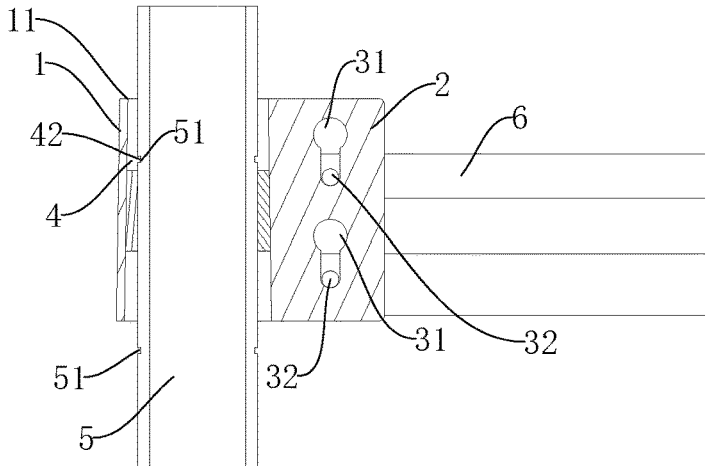
FIG. 14 is a cross-sectional view of Embodiment 6 of the present invention.

As shown in FIGS. 12 to 14, a rod fixing structure of the present embodiment is illustrated and applied to a shelving rack 100.

The rod fixing structure also comprises a connecting sleeve 1. The connecting sleeve 1 has a sleeve hole 11 penetrating through two ends of the connecting sleeve 1, and the sleeve hole 11 is a tapered hole that has an upper portion narrower than a lower portion thereof, meaning that an inner wall of the sleeve hole 11 is tapered. An outer wall of the connecting sleeve 1 is provided with at least two connecting wings 2. Said at least two connecting wings 2 are located around a central axis of the sleeve hole 11 and spaced apart from each other, and said at least two connecting wings 2 are fixed around an outer circumference of the connecting sleeve 1 and project radially from the outer circumference of the connecting sleeve 1. In the present embodiment, each of said at least two connecting wings 2 is provided with at least one quick-connect hole 31.

Accordingly, the connecting sleeve 1 is an independent structure that can be detachably pre-fitted with a sleeve assembly 4 and a support rod 5 that will be described below. Since the connecting sleeve 1 is provided with at least two connecting wings 2 and each of said at least two connecting wings 2 are provided with at least one quick-connect hole 31, at least one quick-connect fastener 32 provided on a horizontal rod 6 can also be quickly and cooperatively connected to a corresponding connecting wing 2. Specifically, referring to FIG. 12, one layer of the shelving rack 100 can be completely formed by providing four support rods 5, four connecting sleeves 1, each connecting sleeve 1 having two connecting wings 2, four horizontal rods 6 each being connected between every two adjacent connecting sleeves 1, and an independent meshed board 81 or partition board disposed on the four horizontal rods 6. Accordingly, by using the connecting sleeve 1 according to the present invention, the shelving rack 100 is simple and quick to assemble.

As shown in FIGS. 12 and 13, the rod fixing structure further comprises a support rod 5 sleeved by the sleeve hole, a sleeve assembly 4 also sleeved by the sleeve hole, and a horizontal rod 6 connected to each of said at least two connecting wings 2. The outer circumference of the connecting sleeve 1 is provided with two connecting wings 2, and the two connecting wings 2 are spaced apart from each other by 90 degrees, i.e., oriented to two perpendicular directions.

The support rod 5 and the sleeve assembly 4 may adopt existing structures. Specifically, an outer circumferential wall of the support rod 5 is provided with a plurality of annular clamping grooves 51 vertical spaced apart from one another. The sleeve assembly 4 comprises two half sleeve bodies 41 that are removably snap-fitted to each other. An inner wall of the sleeve assembly 4 removably abuts the outer circumferential wall of the support rod 5, and the inner wall of the sleeve assembly 4 protrudes with annular ribs 42 that are capable to be fitted in any one of the plurality of annular clamping grooves 51. An outer wall of the sleeve assembly 4 is a tapered wall corresponding to the sleeve hole 11. Thus, the two half sleeve bodies 41 are snap-fitted to each other on the support rod 5, and the annular ribs 42 are positioned at a selected annular clamping groove 51 of the support rod 5. Referring to FIG. 3, when the connecting sleeve 1 sleeve from top to bottom onto the support rod 5 and the sleeve assembly 4, due to gravity force or a pressure of pressing down the connecting sleeve, the tapered sleeve hole 11 of the connecting sleeve 1 presses the sleeve assembly 4 downward, causing the outer wall of the sleeve assembly 4 to be pressed to form an inward embracing force. The more the connecting sleeve 1 is pressed downwardly, the tighter the sleeve assembly 4 embraces the support rod 5, thereby achieving an adjustable yet stable connection and fixation of the connecting sleeve 1 to the support rod 5.

Each of two ends of the horizontal rod 6 is provided with at least one quick-connect fastener 32 corresponding to said at least one quick-connect hole 31 of a corresponding connecting wing 2 so that said at least one quick-connect fastener 32 and said at least one quick-connect hole 31 may be quickly assembled and disassembled. In the present embodiment, each of said at least one quick-connect hole 31 is a gourd-shaped (keyhole-shaped) hole, and each of said at least two connecting wings 2 is provided with two gourd-shaped holes spaced apart from each other vertically. Corresponding, there are two quick-connect fasteners 32 on each of two ends of the horizontal rod 6, and each of the two quick-connect fasteners 32 is bolt-shaped; a bolt head of each bolt-shaped quick-connect fastener can be buckled to a corresponding gourd-shaped hole to achieve quick-disassembly and quick-assembly, thereby effectively improving an installation speed and convenience of the connecting sleeve 1 and the horizontal rod 6.

As shown in FIG. 13, a horizontal cross-section of the sleeve hole 11 is circular. The outer wall of the connecting sleeve 1 may also be correspondingly tapered to define a shape of a conical frustum, or may not be tapered to define a cylindrical shape. Each of said at least two connecting wings 2 is welded and fixed to the outer wall of the connecting sleeve 1.

Embodiment 7

Figure 15:
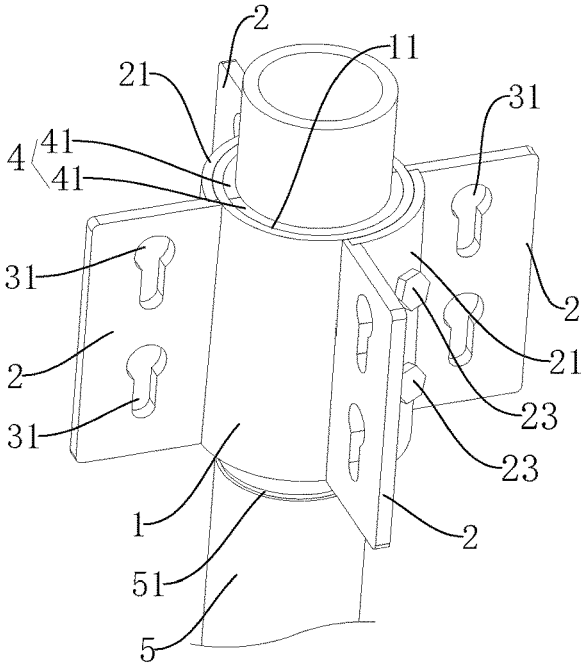
FIG. 15 is a perspective view of the partial structure of Embodiment 7 of the present invention.
Figure 16:
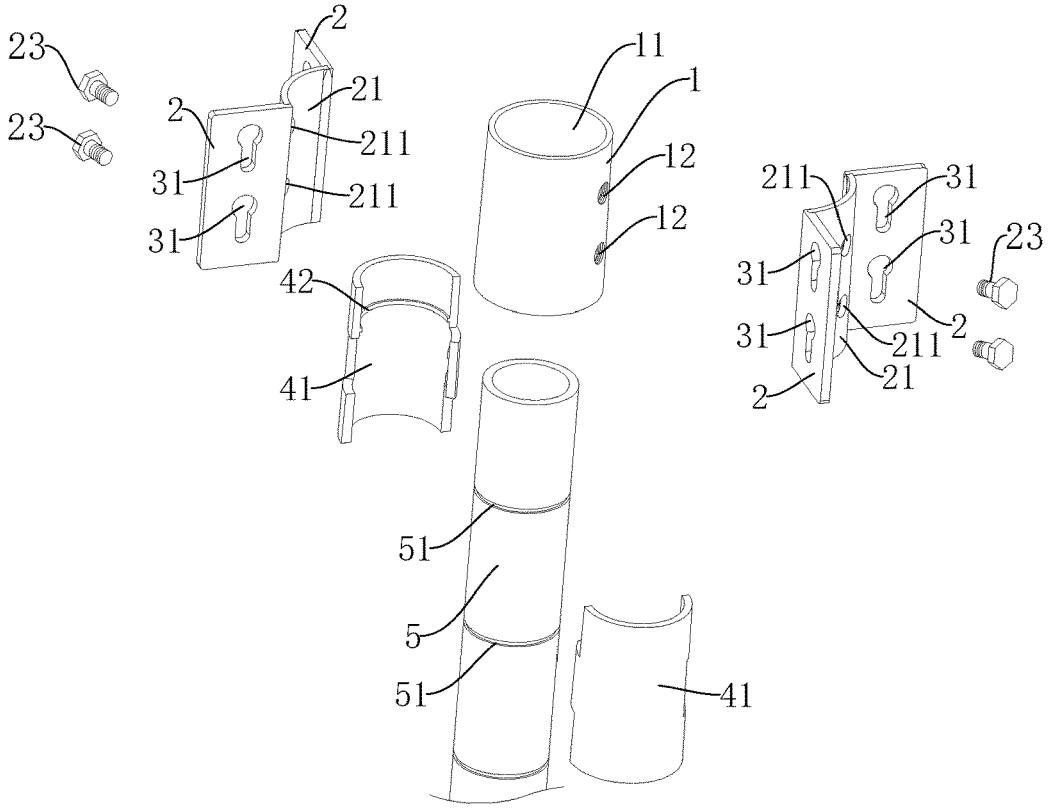
FIG. 16 is an exploded view of the partial structure of Embodiment 7 of the present invention.

As shown in FIGS. 15 and 16, a structure of the present embodiment is similar to a structure of embodiment 6, with a main difference in that said at least two connecting wings 2 of the present embodiment are detachably connected to the connecting sleeve 1.

Said at least two connecting wings 2 may be vertically arranged on the outer wall of the connecting sleeve 1, and inner side edges of said at least two connecting wings 2 are connected to at least one locking portion 21 that abut against the outer wall of the connecting sleeve 1, and each of said at least one locking portion 21 is locked and fixed to the outer wall of the connecting sleeve 1.

Specifically, connecting screws 23 are further included. Each of said at least one locking portion 21 is provided with at least two connecting holes 211 vertically spaced apart from each other. The outer wall of the connecting sleeve 1 corresponding to each of said at least one locking portion 21 is provided with at least two locking holes 12 corresponding to said at least two connecting holes 211, and internal threads are provided in each of said at least two locking holes 12. The connecting screws 23 lock and fix said at least two connecting holes 211 and said at least two locking holes 12. By providing detachable connecting wings 2, a quantity of the connecting wings 2 on the outer wall of the connecting sleeve 1 can be increased or decreased according to actual requirements. Accordingly, the shelving rack 100 can be horizontally extended to different directions, thereby effectively improving the utility of the connecting sleeve 1.

For example, as shown in FIG. 15, said at least two connecting wings 2 comprises four connecting wings 2 spaced apart from one another equivalently by 90-degree around the outer wall of the connecting sleeve 1. Thus, the connecting sleeve 1 and the sleeved support rod 5 can serve as a central support structure for four shelving racks built around the connecting sleeve 1 and the sleeved support rod 5. While saving support rods 5 and connecting sleeves 1, the four shelving racks are connected integrally into one body by the rod connecting structure according to the present embodiment to improve stability performance of the shelving racks.

In the present embodiment, said at least one locking portion 21 comprises two locking portions 21; two side edges of each of the two locking portions 21 oriented vertically on the outer wall of the connecting sleeve 1 are connected to two of the four connecting wings 2 respectively. Accordingly, two connecting wings 2 share one locking portion 21 so as to allow fixation of two connecting wings 2 altogether with a locking operation of one locking portion 21, thereby facilitating more convenient assembly.

Of course, each of said at least one locking portion 21 may also independently connect to one connecting wing 2 only, i.e., the four connecting wings 2 each has one independent locking portion 21, such that there are four locking portions 21.

Embodiment 8

Figure 17:
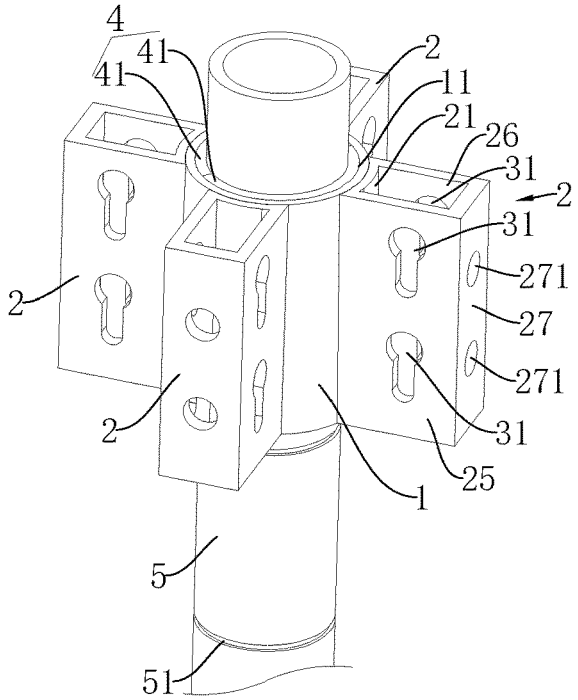
FIG. 17 is a perspective view of the partial structure of Embodiment 8 of the present invention.
Figure 18:
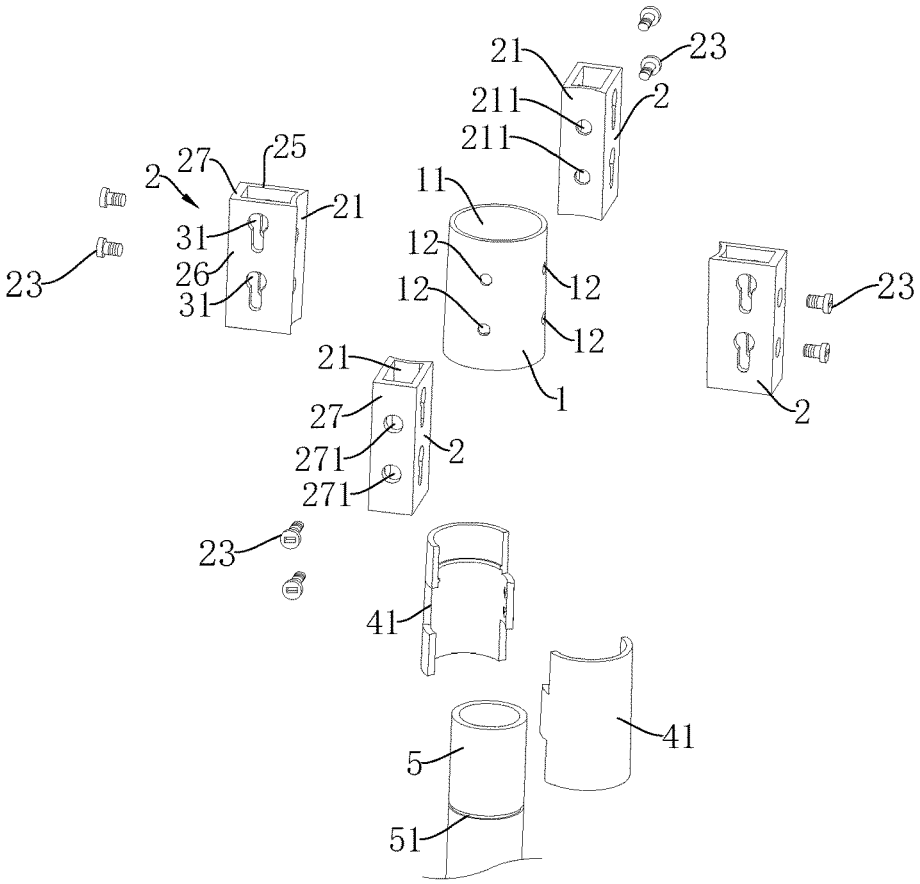
FIG. 18 is an exploded view of the partial structure of Embodiment 8 of the present invention.
Figure 19:
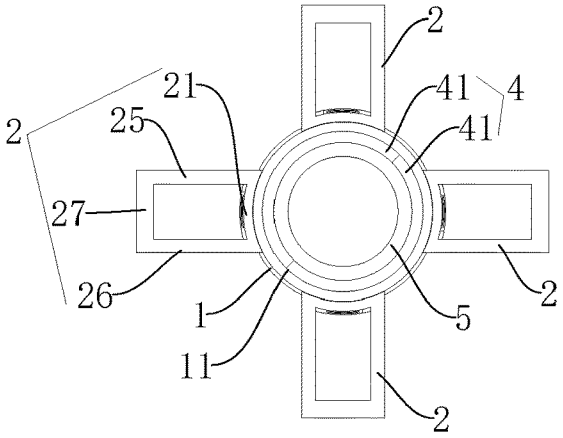
FIG. 19 is a top view of Embodiment 8 of the present invention.

As shown in FIGS. 17 to 19, a structure of the present embodiment is similar to a structure of embodiment 7. Said at least two connecting wings 2 of the present embodiment are also detachably connected to the connecting sleeve 1.

However, each of said at least two connecting wings 2 of the present embodiment comprises a first side plate 25 and a second side plate 26 that are spaced apart from and parallel to each other. The first side plate 25 and the second side plate 26 are each provided with at least one quick-connect hole 31.

A locking portion 21 is connected to inner side edges of the first side plate 25 and the second side plate 26 of each of said at least two connecting wings 2. The locking portion 21 abuts and is locked to the outer wall of the connecting sleeve 1.

Specifically, connecting screws 23 are further included. Each locking portion 21 is provided with at least two connecting holes 211 vertically spaced apart from each other. The outer wall of the connecting sleeve 1 corresponding to each locking portion 21 is provided with at least two locking holes 12 corresponding to said at least two connecting holes 211, and internal threads are provided in each of said at least two locking holes 12. In the present embodiment, a reinforcing plate 27 is connected to outer side edges of the first side plate 25 and the second side plate 26 of each locking portion 21 to enhance a structural stability of the first side plate 25 and the second side plate 26. The reinforcing plate 27 is provided with at least two alignment holes 271 corresponding to said at least two connecting holes 211. The connecting screws pass through said at least two alignment holes 271 and are then locked and fixed with said at least two connecting holes 211 and said at least two locking holes 12.

An interval between the first side plate 25 and the second side plate 26 forms a gap. Thus, when said at least one quick-connect fastener 32 at one end of the horizontal rod 6 is inserted into said at least one quick-connect hole 31 of the first side plate 25 or the second side plate 26, said at least one quick-connect fastener 32 can be hidden in the gap, avoiding accidental scraping or damage caused by exposed protruding quick-connect fastener(s) 32.

Embodiment 9

Figure 20:
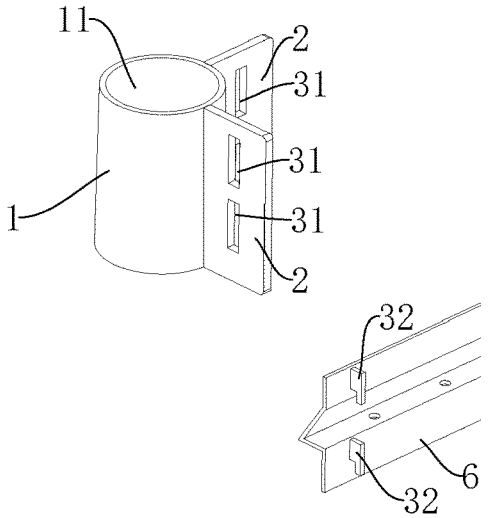
FIG. 20 is a perspective view of a connecting sleeve and a horizontal rod of Embodiment 9 of the present invention.

As shown in FIG. 20, a structure of the present embodiment is similar to a structure of the above embodiment 6, with a main difference in that each of said at least one quick-connect hole 31 is a vertically elongated rectangular hole, and each of said at least one quick-connect fastener 32 is a right-angled protrusion.

Embodiment 10

Figure 21:
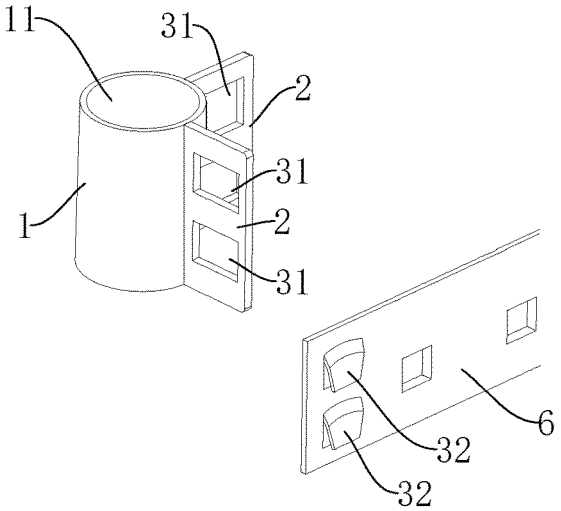
FIG. 21 is a perspective view of a connecting sleeve and a horizontal rod of Embodiment 10 of the present invention.

As shown in FIG. 21, a structure of the present embodiment is similar to a structure of the above embodiment 6, with a main difference in that each of said at least one quick-connect hole 31 is a horizontally elongated rectangular hole, and each of said at least one quick-connect fastener 32 is a protruded tapered elastic insertion plate.

Embodiment 11

Figure 22:
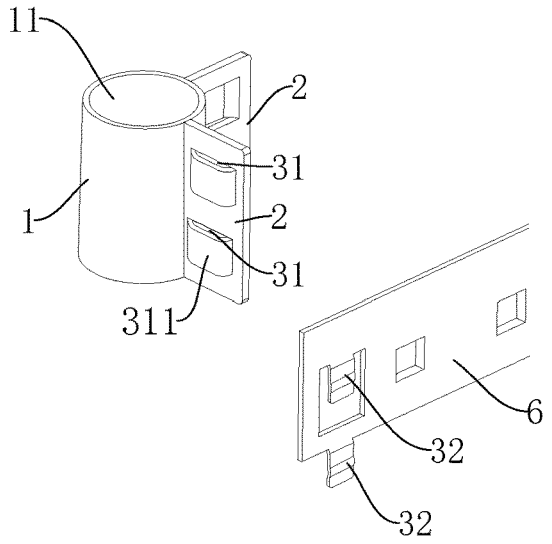
FIG. 22 is a perspective view of a connecting sleeve and a horizontal rod of Embodiment 11 of the present invention.

As shown in FIG. 22, a structure of the present embodiment is similar to a structure of the above embodiment 6, with a main difference in that each of said at least one quick-connect hole 31 is an insertion slot formed by a gap between a corresponding connecting wing 2 and a position limiting plate 311 disposed on the corresponding connecting wing 2, and each of said at least one quick-connect fastener 32 is an insertion latch having a bulge thereon. After mutual insertion, the two provide a good fastening effect.

In summary, the present invention provides the connecting sleeve 1 with at least two connecting wings 2, thus facilitating quick disassembly and assembly of assembled products with rod members such as a shelving rack 100, improving product assembly and disassembly efficiency and enhancing user's experience. Each of said at least two connecting wings 2 is provided with at least one quick-connect hole 31, and a corresponding horizontal rod 6 connected to each of said at least two connecting wings 2 is provided with at least one quick-connect fastener 32. Of course, each of said at least two connecting wings 2 may alternatively be provided with at least one quick-connect fastener 32 and the corresponding horizontal rod 6 connected to each of said at least two connecting wings 2 is correspondingly provided with said at least one quick-connect hole 31, and quick-disassembly and quick-assembly connection can likewise be achieved.

Each of said at least one quick-connect hole 31 may also be a teardrop-shaped hole, and each of said at least one quick-connect fastener 32 corresponding to the teardrop-shaped hole may be a bolt-shaped protruding structure.

Embodiment 12

Figure 23:
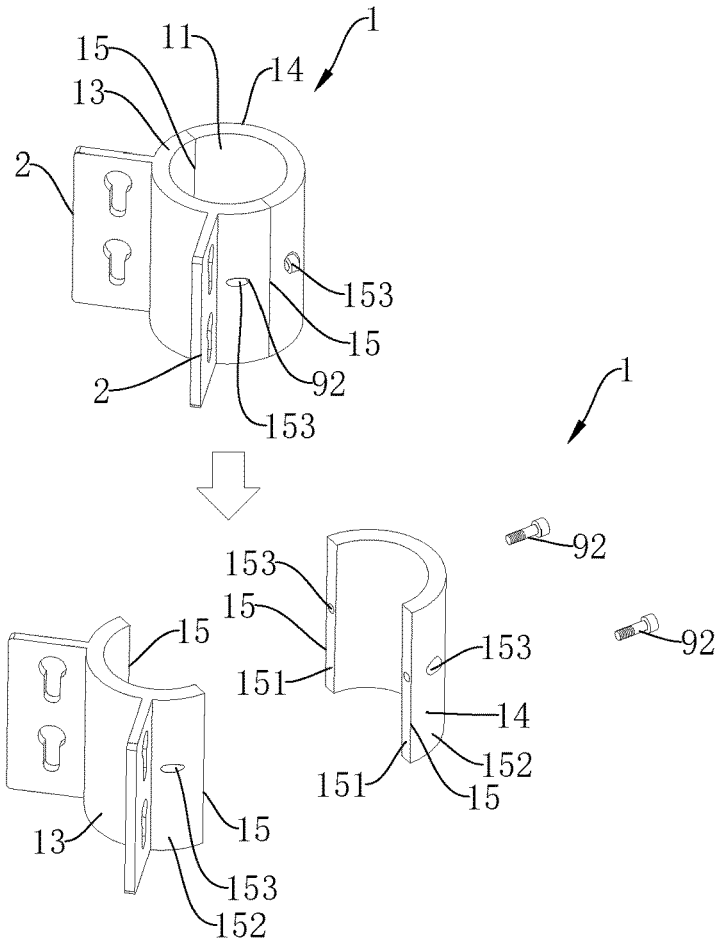
FIG. 23 is a schematic view of disassembling the connecting sleeve of Embodiment 12 of the present invention.

As shown in FIG. 23, a structure of the present embodiment is similar to a structure of the above embodiment 6, with a main difference in that the connecting sleeve 1 is an assembled structure.

Specifically, the connecting sleeve 1 is divided longitudinally along a diameter thereof into a first arc piece 13 and a second arc piece 14 that are detachably connected. After connecting the first arc piece 13 and the second arc piece 14, the sleeve hole 11 is defined between the first arc piece 13 and the second arc piece 14.

Each of two side end surfaces 15 of each of the first arc piece 13 and the second arc piece 14 is provided with a connecting locking hole 153 penetrating an end face 151 of respective side end surface 15 and an outer arc surface 152 of a respective one of the first arc piece 13 and the second arc piece 14, such that there are two connecting locking holes 153 on the first arc piece 13, and two connecting locking holes 153 on the second arc piece 14. When the first arc piece 13 and the second arc piece 14 are connected, the two connecting locking holes 153 of the first arc piece 13 align with the two connecting locking holes 153 of the second arc piece 14 respectively. A locking screw 92 is threaded through each pair of aligned connecting locking holes 153 to securely lock the first arc piece 13 and the second arc piece 14 into an integral structure.

The two connecting locking holes 153 of the first arc piece 13 are provided with internal threads, while the two connecting locking holes 153 of the second arc piece 14 are smooth holes and each having a countersink on one side close to the outer arc surface 152 of the second arc piece 14 for limiting a screw head of the locking screw 92 and for tighter connection of the first arc piece 13 and the second arc piece 14.

In the present embodiment, said at least two connecting wings 2 of the connecting sleeve 1 may be provided on the first arc piece 13 or on the second arc piece 14.

Accordingly, by configuring the connecting sleeve 1 as a detachably assembled structure, when it is necessary to add a new intermediate meshed board 81 between an existing upper meshed board 81 and an existing lower meshed board 81 of the shelving rack 100, it is not required to remove the upper meshed board 81 in order to insert the new intermediate meshed board 81. It is only necessary to disassemble the connecting sleeves 1 for the new intermediate meshed board 81, fit the first arc piece 13 and the second arc piece 14 of each connecting sleeve 1 onto an outer periphery of two half sleeve bodies 41 of a corresponding support rod 5, and then lock the locking screws 92 to achieve fixation of each connecting sleeve 1 and the corresponding support rod 5. Then the horizontal rods 6 are quick-connected by the connecting wings 2 of the connecting sleeves 1 to realize installation of the new intermediate meshed board 81.

In the present embodiment, one said connecting locking hole 153 is provided in a middle point of each of two side end surfaces 15 of each of the first arc piece 13 and the second arc piece 14. Of course, a plurality of connecting locking holes 153 may also be provided along a longitudinal direction of each side end surface 15 to enhance locking effects of the first arc piece 13 and the second arc piece 14.

Embodiment 13

Figure 24:
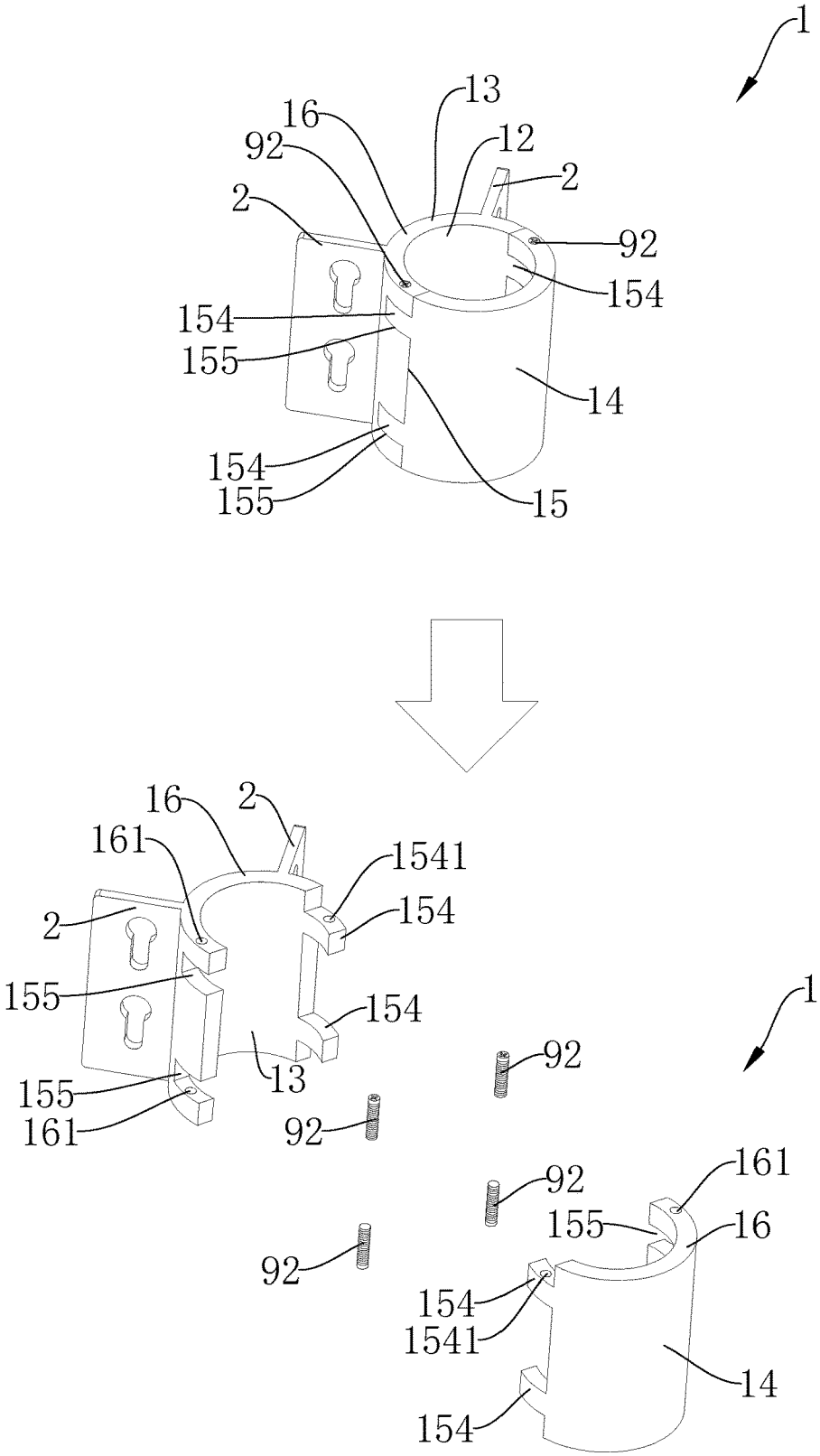
FIG. 24 is a schematic view of disassembling the connecting sleeve of Embodiment 13 of the present invention.

As shown in FIG. 24, a structure of the present embodiment is similar to a structure of the above embodiment 6, with a main difference in that the connecting sleeve 1 is an assembled structure.

Specifically, the connecting sleeve 1 is divided longitudinally along a diameter thereof into a first arc piece 13 and a second arc piece 14 that are detachably connected. After connecting the first arc piece 13 and the second arc piece 14, the sleeve hole 11 is defined between the first arc piece 13 and the second arc piece 14.

One of two side end surfaces 15 of each of the first arc piece 13 and the second arc piece 14 is provided with two locking blocks 154 vertically spaced apart from each other and protrude along a circumferential direction of the connecting sleeve 1, and another one of two side end surfaces 15 of each of the first arc piece 13 and the second arc piece 14 is recessed along the circumferential direction of the connecting sleeve 1 to form two locking grooves 155 vertically spaced apart from each other. Also, upper and lower end surfaces 16 of each of the first arc piece 13 and the second arc piece 14 are provided with two locking through holes 161 respectively that axially communicate with the two locking grooves 155 thereon respectively. When the first arc piece 13 and the second arc piece 14 are connected, the two locking blocks 154 of the first arc piece 13 are embedded into the two locking grooves 155 of the second arc piece 14, and the two locking blocks 154 of the second arc piece 14 are correspondingly embedded into the two locking grooves 155 of the first arc piece 13. Moreover, each locking block 154 on the first arc piece 13 and the second arc piece 14 is provided with a locking bottom hole 1541 corresponding to a respective locking through hole 161. Then four locking screws 92 pass through four locking through holes 161 and lock into corresponding locking bottom holes 1541 respectively, thereby achieving connecting between the first arc piece 13 and the second arc piece 14.

Accordingly, by configuring the connecting sleeve 1 as a detachably assembled structure, when it is necessary to add a new intermediate meshed board 81 between an existing upper meshed board 81 and an existing lower meshed board 81 of the shelving rack 100, it is not required to remove the upper meshed board 81 in order to insert the new intermediate meshed board 81. It is only necessary to disassemble the connecting sleeves 1 for the new intermediate meshed board 81, fit the first arc piece 13 and the second arc piece 14 of each connecting sleeve 1 onto an outer periphery of two half sleeve bodies 41 of a corresponding support rod 5, and then lock the locking screws 92 to achieve fixation of each connecting sleeve 1 and the corresponding support rod 5. Then the horizontal rods 6 are quick-connected by the connecting wings 2 of the connecting sleeves 1 to realize installation of the new intermediate meshed board 81.

In the present embodiment, two locking blocks 154 is provided on one of two side end surfaces 15 of each of the first arc piece 13 and the second arc piece 14, and two locking grooves 155 are provided on another one of two side end surfaces 15 of each of the first arc piece 13 and the second arc piece 14. Of course, only one locking groove 155 and only one locking block 154 may be provided instead with correspondingly one locking through hole 161 on the upper or lower end surfaces 16 of each of the first arc piece 13 and the second arc piece 14; likewise, connection between the first arc piece 13 and the second arc piece 14 can still be achieved.

Embodiment 14

Figure 25:
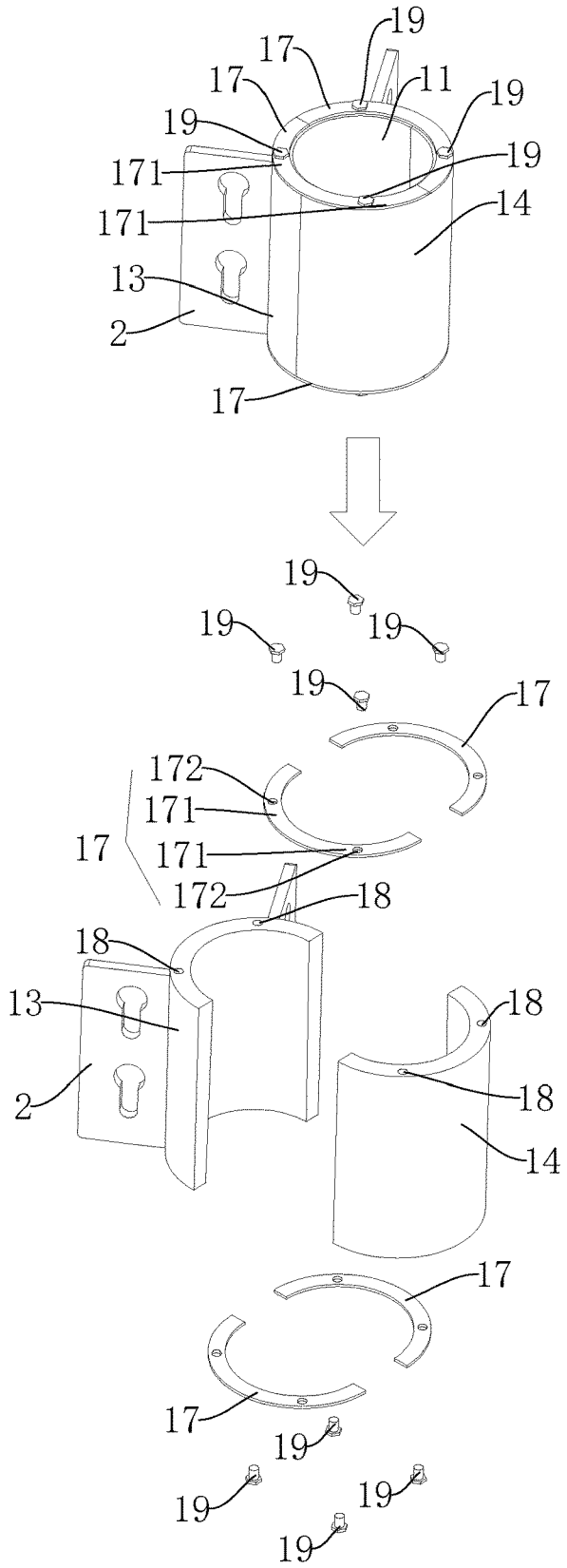
FIG. 25 is a schematic view of disassembling the connecting sleeve of Embodiment 14 of the present invention.

As shown in FIG. 25, a structure of the present embodiment is similar to a structure of Embodiment 1 above, with a main difference in that the connecting sleeve 1 is an assembled structure.

The connecting sleeve 1 is divided longitudinally along a diameter thereof into a first arc piece 13 and a second arc piece 14 that are detachably connected. After connecting the first arc piece 13 and the second arc piece 14 to form the connecting sleeve 1, each of two end surfaces of the connecting sleeve 1 formed by the first arc piece 13 and the second arc piece 14 is locked with two half-ring locking pieces 17 respectively. The sleeve hole 11 is defined between the first arc piece 13 and the second arc piece 14.

Each half-ring locking piece 17 has two locking piece connecting portions 171 distributed along a circumferential direction of the connecting sleeve 1, and the two locking piece connecting portions 171 abut against upper end surfaces of the first arc piece 13 and the second arc piece 14 respectively, or abut against lower end surfaces of the first arc piece 13 and the second arc piece 14 respectively. Further, each locking piece connecting portion 171 is provided with a locking piece through hole 172. The upper end surfaces of the first arc piece 13 and the second arc piece 14 and the lower end surfaces of the first arc piece 13 and the second arc piece 14 are each provided with two arc piece locking holes 18 corresponding to two locking piece through holes 172 from two half-ring locking pieces 17 respectively. Fasteners 19 such as screws can pass through all locking piece through holes 172 and then lock into all arc piece locking holes 18 respectively, so that all half-ring locking pieces 17 are locked and fixed to the first arc piece 13 and the second arc piece 14.

Each of the two end surfaces of the connecting sleeve 1 formed by the first arc piece 13 and the second arc piece 14 is locked by the two half-ring locking pieces 17. Thus, by providing a total of four half-ring locking pieces 17 on the upper and lower end surfaces of the connecting sleeve 1, connection of the first arc piece 13 and the second arc piece 14 can be achieved to securely form the connecting sleeve 1.

In the present embodiment, said at least two connecting wings 2 of the connecting sleeve 1 may be provided on the first arc piece 13 or on the second arc piece 14.

Accordingly, by configuring the connecting sleeve 1 as a detachably assembled structure, when it is necessary to add a new intermediate meshed board 81 between an existing upper meshed board 81 and an existing lower meshed board 81 of the shelving rack 100, it is not required to remove the upper meshed board 81 in order to insert the new intermediate meshed board 81. It is only necessary to disassemble the connecting sleeves 1 for the new intermediate meshed board 81, fit the first arc piece 13 and the second arc piece 14 of each connecting sleeve 1 onto an outer periphery of two half sleeve bodies 41 of a corresponding support rod 5, and then lock the four half-ring locking pieces 17 to achieve fixation of each connecting sleeve 1 and the corresponding support rod 5. Then the horizontal rods 6 are quick-connected by the connecting wings 2 of the connecting sleeves 1 to realize installation of the new intermediate meshed board 81.

Embodiment 15

Figure 26:
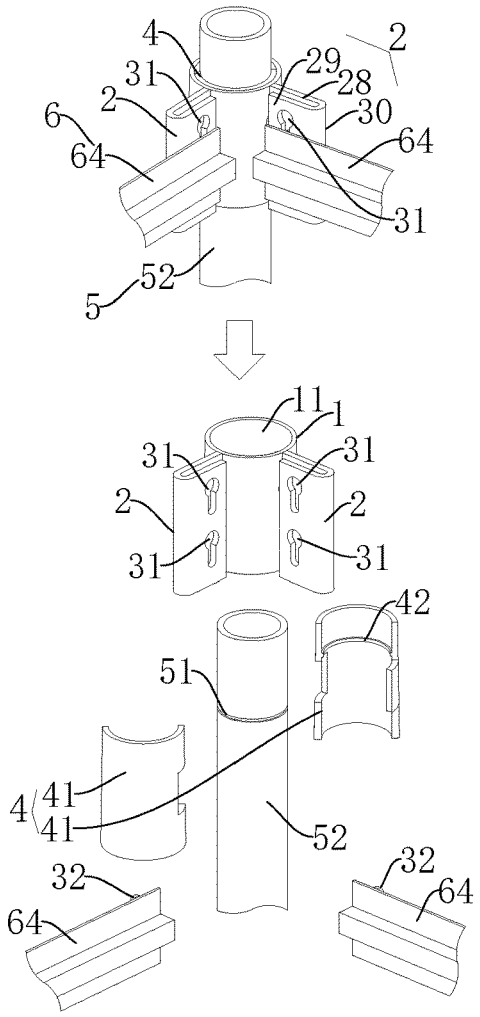
FIG. 26 is a perspective and exploded schematic view of the partial structure of Embodiment 15 of the present invention.
Figure 27:
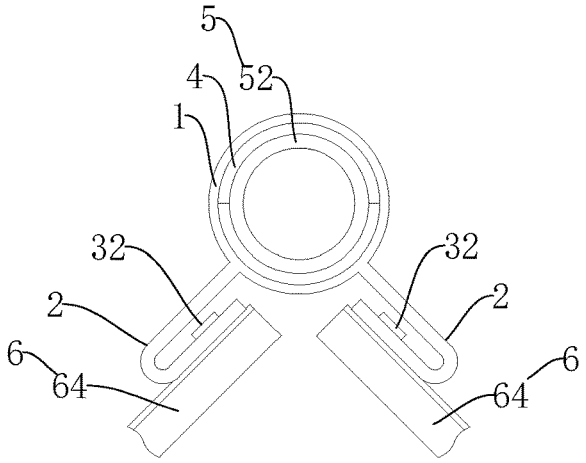
FIG. 27 is a top schematic view of the partial structure of Embodiment 15 of the present invention.

As shown in FIGS. 26 to 27, a structure of the present embodiment is similar to a structure of the above embodiment 6, with a main difference in that the rod fixing structure of the present embodiment is applied to a bed frame.

The support rod 5 is a bed leg rod 52, and the horizontal rod 6 is a cross beam rod 64.

An upper portion of the bed leg rod 52 can be sleeved by the connecting sleeve 1, and the sleeve assembly 4 is provided between the connecting sleeve 1 and the bed leg rod 52.

The connecting sleeve 1 allows a top end of the bed leg rod 52 to be exposed and thus the top end of the bed leg rod 52 can be further connected to a headboard structure or a footboard structure (not shown in the figures).

Under gravity force or a pressure of pressing down the cross beam rod 64, the connecting sleeve 1 presses the sleeve assembly 4 downward, causing the outer wall of the sleeve assembly 4 to be pressed by the tapered sleeve hole 11 of the connecting sleeve 1 while the inner wall of the sleeve assembly 4 presses inward against the bed leg rod 52, so that the annular ribs 42 tightly engage with a corresponding annular clamping groove 51, thereby ensuring stability of connection between the connecting sleeve 1 and the bed leg rod 52.

Accordingly, when assembling the bed frame, no tools are required. A user can manually achieve convenient and quick connection between the bed leg rod 52 and a corresponding cross beam rod 64 through said at least one quick-connect hole 31 and said at least one quick-connect fastener 32, so that assembly of the bed frame is simple and easy and convenient for the user to assemble by himself/herself. Later, bed slats or a frame preinstalled with bed slats (not shown in the figures) are placed on the cross beam rods 64, and then a mattress (not shown in the figures) is placed on top. A weight of the mattress presses the bed leg rods 52 and the cross beam rods 64 tightly, which can prevent separation of the bed leg rods 52 from the cross beam rods 64.

In the present embodiment, each of said at least two connecting wings 2 comprises a fixing piece 28 and a connecting piece 29 that are parallel and spaced apart from each other. An inner end of the fixing piece 28 is connected to the outer wall of the connecting sleeve 1 disposed at the upper portion of the bed leg rod 52, particularly being fixed to the outer wall of the connecting sleeve 1 by welding.

An outer end of the fixing piece 28 and an outer end of the connecting piece 29 are integrally connected through an arc-shaped connecting section 30. Specifically, the fixing piece 28 and the connecting piece 29 may be formed by bending a single piece of plate structure.

The connecting piece 29 is provided with at least one quick-connect hole 31. Thus, when said at least one quick-connect fastener 32 provided at an end of a corresponding cross beam rod 64 is fitted into said at least one quick-connect hole 31, the fixing piece 28 can conceal said at least one quick-connect fastener 32, ensuring a sightly appearance of a product while also preventing the protruding said at least one quick-connect fastener 32 from scraping the user and causing injury, etc.

Embodiment 16

Figure 28:
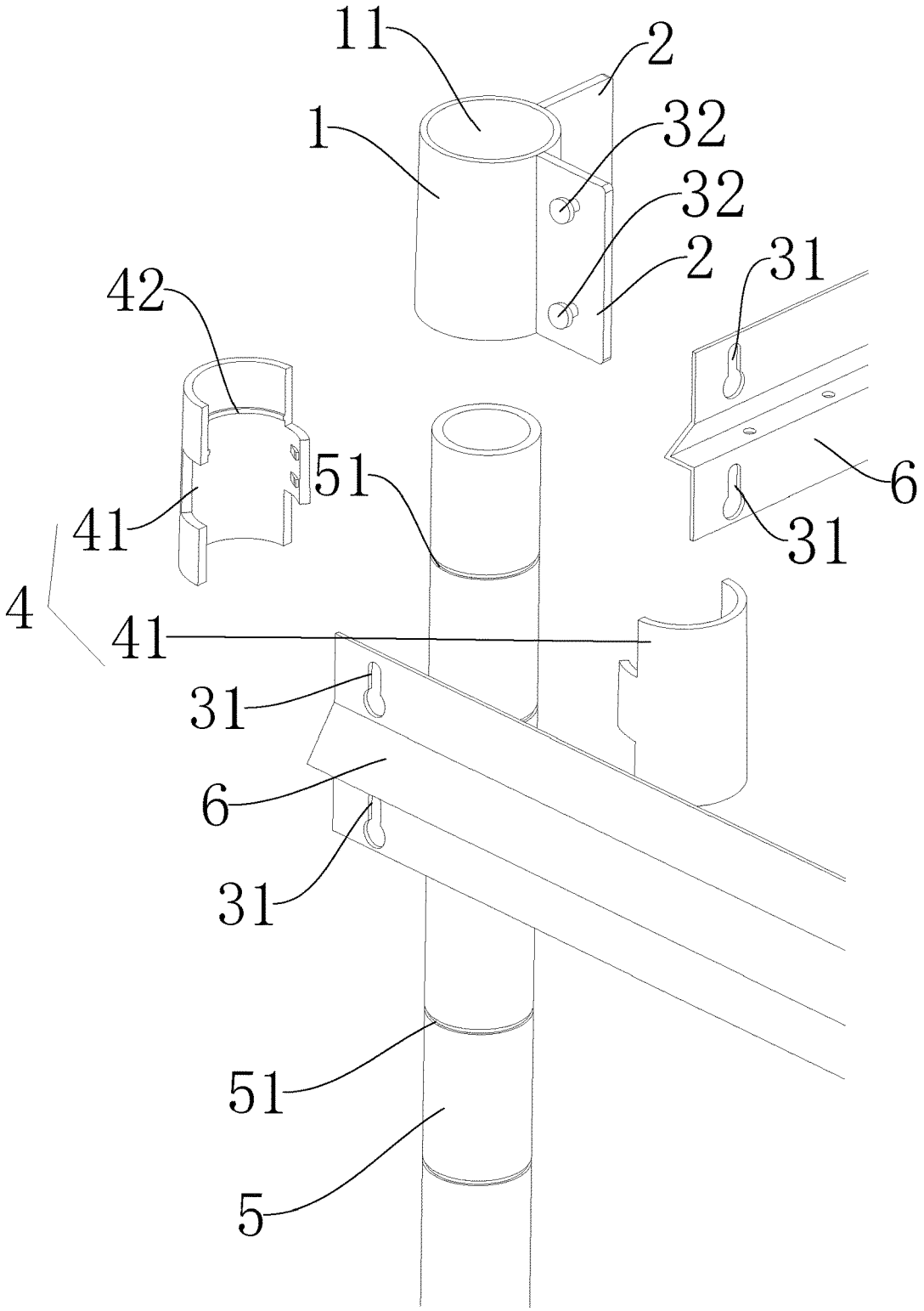
FIG. 28 is an exploded view of a partial structure of Embodiment 16 of the present invention.

As shown in FIG. 28, a structure of the present embodiment is similar to a structure of the above embodiment 6, with a main difference in that:

There are at least two connecting wings 2 on the connecting sleeve 1, and each of said at least two connecting wings 2 is provided with at least one quick-connect fastener 32, and each of two ends of the horizontal rod 6 is provided with at least one quick-connect hole 31 corresponding respectively to said at least one quick-connect fastener 32 of the corresponding connecting wing to achieve quick connection between the horizontal rod 6 and the corresponding connecting wing 2.

Specifically, each of said at least two connecting wings 2 is provided with said at least one quick-connect fastener 32 each being a bolt, and each of said at least one quick-connect hole 31 on each of two ends of the horizontal rod 6 has a gourd-shape; a bolt head of each of said at least one quick-connect fastener 32 can be quickly buckled with a corresponding gourd-shape quick-connect hole 31 on a corresponding end of the horizontal rod 6. Likewise, the speed and convenience of assembly between the connecting sleeve 1 and the horizontal ford 6 can be effectively enhanced.

The invention claimed is:

1. A rod fixing structure, comprising a connecting sleeve; the connecting sleeve has a sleeve hole penetrating through two ends of the connecting sleeve, and the sleeve hole is a tapered hole that has an upper portion narrower than a lower portion thereof; an outer wall of the connecting sleeve is provided with at least two connecting wings; said at least two connecting wings are located around a central axis of the sleeve hole and spaced apart from each other, and said at least two connecting wings are fixed around an outer circumference of the connecting sleeve and project radially from the outer circumference of the connecting sleeve; the connecting sleeve is configured to sleeve a support rod which is vertically arranged, and each of said at least two connecting wings is configured to be locked or buckled to a horizontal rod which is horizontally arranged, each of said at least two connecting wings is provided with at least one quick-connect hole or at least one connect fastener; each of two ends of the horizontal rod is provided with at least one quick-connect fastener or at least one quick-connect hole corresponding respectively to said at least one quick-connect hole or said at least one quick-connect fastener of a corresponding connecting wing.

2. The rod fixing structure of claim 1, wherein a horizontal cross-section of the sleeve hole is circular; the outer wall of the connecting sleeve is tapered to define a shape of a conical frustum.

3. The rod fixing structure of claim 1, wherein each of said at least two connecting wings is welded and fixed to the outer wall of the connecting sleeve.

4. The rod fixing structure of claim 1, wherein said at least two connecting wings are vertically arranged on the outer wall of the connecting sleeve; inner side edges of said at least two connecting wings are connected to locking portions that abut against the outer wall of the connecting sleeve, and the locking portions are locked and fixed to the outer wall of the connecting sleeve.

5. The rod fixing structure of claim 4, also comprising connecting screws; each of the locking portions is provided with at least two connecting holes vertically spaced apart from each other; portions of the outer wall of the connecting sleeve corresponding to the locking portions are each provided with at least two locking holes corresponding to said at least two connecting holes, and internal threads are provided in each of said at least two locking holes; an exact quantity of the connecting screws corresponds to an exact quantity of said at least two connecting holes; the connecting screws pass through said at least two connecting holes and are locked into said at least two locking holes respectively, thereby locking and fixing said at least two connecting wings to the connecting sleeve.

6. The rod fixing structure of claim 5, wherein each of said at least two connecting wings comprises a first side plate and a second side plate that are spaced apart from and parallel to each other; a respective one of the locking portions is connected to inner side edges of the first side plate and the second side plate of each of said at least two connecting wings; the first side plate and the second side plate are each provided with at least one quick-connect hole; a reinforcing plate is connected to outer side edges of the first side plate and the second side plate of each of the locking portions; the reinforcing plate is provided with at least two alignment holes corresponding to said at least two connecting holes; the connecting screws pass through said at least two alignment holes and are then locked and fixed with said at least two connecting holes and said at least two locking holes.

7. The rod fixing structure of claim 1, wherein said at least two connecting wings comprise two to four connecting wings spaced apart from one another equivalently by 90-degree around the outer wall of the connecting sleeve.

8. The rod fixing structure of claim 1, wherein the connecting sleeve is an assembled structure; the connecting sleeve is divided longitudinally along a diameter thereof into a first arc piece and a second arc piece that are detachably connected; the sleeve hole is defined between the first arc piece and the second arc piece connected to each other.

9. The rod fixing structure of claim 8, wherein each of two side end surfaces of each of the first arc piece and the second arc piece is provided with at least one connecting locking hole penetrating an end face of a respective side end surface and an outer arc surface of a respective one of the first arc piece and the second arc piece, such that there are at least two connecting locking holes on the first arc piece and at least two connecting locking holes on the second arc piece; when the first arc piece and the second arc piece are connected, said at least two connecting locking holes of the first arc piece align with said at least two connecting locking holes of the second arc piece respectively; a locking screw is detachably threaded through each pair of aligned connecting locking holes.

10. The rod fixing structure of claim 8, wherein one of two side end surfaces of each of the first arc piece and the second arc piece is provided with at least one locking block that protrudes along a circumferential direction of the connecting sleeve, and another one of two side end surfaces of each of the first arc piece and the second arc piece is recessed along the circumferential direction of the connecting sleeve to form at least one locking groove; each of upper and/or lower end surfaces of each of the first arc piece and the second arc piece is provided with a locking through hole that corresponds and axially communicate with said at least one locking groove thereon; when the first arc piece and the second arc piece are connected, said at least one locking block of the first arc piece is embedded into said at least one locking groove of the second arc piece, and said at least one locking block of the second arc piece is correspondingly embedded into said at least one locking groove of the first arc piece; each locking block on the first arc piece and the second arc piece is provided with a locking bottom hole corresponding to a respective locking through hole; a locking screw is detachably locked into each pair of corresponding locking bottom hole and locking through hole.

11. The rod fixing structure of claim 8, wherein when the first arc piece and the second arc piece is connected to form the connecting sleeve, each of two end surfaces of the connecting sleeve formed by the first arc piece and the second arc piece is locked with two half-ring locking pieces respectively, such that there are two half-ring locking pieces on an upper end surface of the connecting sleeve, and two half-ring locking pieces on a lower end surface of the connecting sleeve; each half-ring locking piece has two locking piece connecting portions distributed along a circumferential direction of the connecting sleeve, and the two locking piece connecting portions span on a respective one of the upper end surface and the lower end surface of the connecting sleeve at least across a point of connection between the first arc piece and the second arc piece so as to lock the first arc piece and the second arc piece; each locking piece connecting portion is provided with at least one locking piece through hole; an upper end surface of the first arc piece and an upper end surface of the second arc piece are each provided with at least two arc piece locking holes corresponding to at least two locking piece through holes from two locking piece connecting portions of the two half-ring locking pieces on the upper end surface of the connecting sleeve respectively; similarly, a lower end surface of the first arc piece and a lower end surface of the second arc piece are each provided with at least two arc piece locking holes corresponding to at least two locking piece through holes from two locking piece connecting portions of the two half-ring locking pieces on the lower end surface of the connecting sleeve respectively; fasteners are provided to pass through all locking piece through holes respectively and then lock into corresponding arc piece locking holes respectively, so that all half-ring locking pieces are locked and fixed to the first arc piece and the second arc piece.

12. The rod fixing structure of claim 1, also comprising a sleeve assembly; an outer circumferential wall of the support rod is provided with a plurality of annular clamping grooves; the sleeve assembly comprises two half sleeve bodies that are removably snap-fitted to each other; an inner wall of the sleeve assembly removably abuts the outer circumferential wall of the support rod, and the inner wall of the sleeve assembly protrudes with annular ribs that are capable of being fitted in any one of the plurality of annular clamping grooves; an outer wall of the sleeve assembly is a tapered wall corresponding to the sleeve hole.

13. The rod fixing structure of claim 1, wherein each quick-connect hole is a gourd-shaped hole, a vertically elongated rectangular hole, or a horizontally elongated rectangular hole; each quick-connect fastener is a bolt-shaped protruding structure, a right-angled protrusion, or a protruded tapered elastic insertion plate.

14. The rod fixing structure of claim 1, wherein the support rod is a bed leg rod, and the horizontal rod is a cross beam rod; an upper portion of the bed leg rod is sleeved by the connecting sleeve; a sleeve assembly is provided between the connecting sleeve and the bed leg rod; an outer wall of the upper portion of the bed leg rod is provided with an annular clamping groove; the sleeve assembly comprises two half sleeve bodies that are removably snap-fitted to each other; an inner wall of the sleeve assembly removably abuts an outer circumferential wall of the bed leg rod, and the inner wall of the sleeve assembly protrudes with annular ribs that are capable of being fitted in the annular clamping groove; an outer wall of the sleeve assembly is a tapered wall corresponding to the sleeve hole; the connecting sleeve sleeves the sleeve assembly.

15. The rod fixing structure of claim 14, wherein each of said at least two connecting wings comprises a fixing piece and a connecting piece that are parallel and spaced apart from each other; an inner end of the fixing piece is connected to the outer wall of the connecting sleeve disposed at the upper portion of the bed leg rod; an outer end of the fixing piece and an outer end of the connecting piece are integrally connected through an arc-shaped connecting section; the connecting piece is provided with said at least one quick-connect hole.

* * * * *